US008038290B2

(12) United States Patent
Kato

(10) Patent No.: US 8,038,290 B2
(45) Date of Patent: Oct. 18, 2011

(54) IMAGE RECORDING APPARATUS

(75) Inventor: Shigeki Kato, Toyoaki (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 860 days.

(21) Appl. No.: 12/057,619

(22) Filed: Mar. 28, 2008

(65) Prior Publication Data

US 2008/0239051 A1 Oct. 2, 2008

(30) Foreign Application Priority Data

Mar. 30, 2007 (JP) ..... 2007-091739

(51) Int. Cl.
*B41J 2/01* (2006.01)
*B41J 29/38* (2006.01)

(52) U.S. Cl. ..... 347/107; 347/16; 347/104

(58) Field of Classification Search ..... 347/16, 347/104, 107
See application file for complete search history.

(56) References Cited

U.S. PATENT DOCUMENTS

| | | | | |
|---|---|---|---|---|
| 6,652,938 | B1 * | 11/2003 | Nishikawa et al. | 428/35.9 |
| 7,036,922 | B2 | 5/2006 | Nakashima | |
| 2006/0139431 | A1 | 6/2006 | Nakashima | |

FOREIGN PATENT DOCUMENTS

| | | | | |
|---|---|---|---|---|
| JP | 59-227657 | A | | 12/1984 |
| JP | 4-007235 | A | | 1/1992 |
| JP | 6-056292 | A | | 3/1994 |
| JP | 2003-208057 | A | | 7/2003 |
| JP | 2004149284 | A | * | 5/2004 |
| JP | 2006-327725 | A | | 12/2006 |
| JP | 2007-001171 | A | | 1/2007 |

OTHER PUBLICATIONS

Office Action in Japanese counterpart application No. 2007-091739, dated Feb. 3, 2009. Partial English translation only.

* cited by examiner

*Primary Examiner* — Daniel Petkovsek
(74) *Attorney, Agent, or Firm* — Banner & Witcoff, Ltd.

(57) ABSTRACT

An image recording apparatus includes a recording head that records an image on a recording medium. A conveyor supports the recording medium on an outer surface thereof so as to convey the recording medium in a conveying direction, and has an attachment region and a non-attachment region on its outer surface. The recording medium is attachable to the attachment region with a first attachment force greater than a second attachment force of the non-attachment region. A medium feeder is configured to feed the recording medium to the conveyor so that at least a part of a leading edge of the recording medium in the conveying direction is positioned on the non-attachment region.

20 Claims, 12 Drawing Sheets

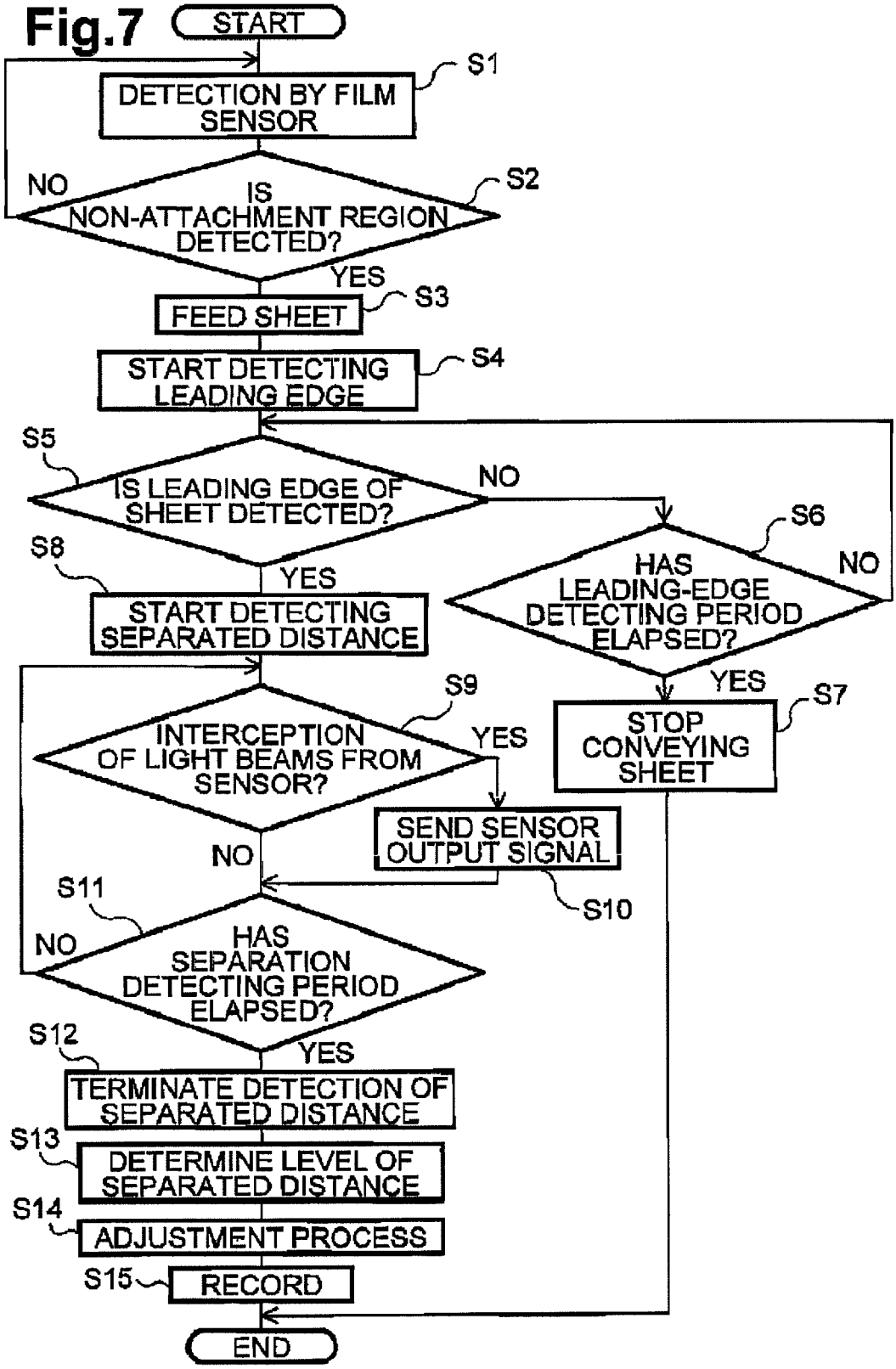
Fig.7
START
S1
DETECTION BY FILM SENSOR
S2
IS NON-ATTACHMENT REGION DETECTED?
NO
YES
S3
FEED SHEET
S4
START DETECTING LEADING EDGE
S5
IS LEADING EDGE OF SHEET DETECTED?
NO
YES
S6
HAS LEADING-EDGE DETECTING PERIOD ELAPSED?
NO
YES
S7
STOP CONVEYING SHEET
S8
START DETECTING SEPARATED DISTANCE
S9
INTERCEPTION OF LIGHT BEAMS FROM SENSOR?
YES
NO
SEND SENSOR OUTPUT SIGNAL
S10
S11
HAS SEPARATION DETECTING PERIOD ELAPSED?
NO
YES
S12
TERMINATE DETECTION OF SEPARATED DISTANCE
S13
DETERMINE LEVEL OF SEPARATED DISTANCE
S14
ADJUSTMENT PROCESS
S15
RECORD
END

IMAGE RECORDING APPARATUS

BACKGROUND

1. Technical Field

The present application relates to an image recording apparatus that records an image onto a recording medium supported on an outer surface of a conveyor.

2. Description of the Related Art

Conventional inkjet printers are known to be equipped with inkjet heads having ink discharge surfaces provided with ink discharging nozzles, and a conveyor belt suspended between two rollers. In such printers, a sheet fed from a feeder portion is conveyed by the conveyor belt while being attached to a conveying surface of the conveyor belt that faces the ink discharge surfaces. In the course of the conveying process, the sheet undergoes image recording and is subsequently ejected onto an ejection portion.

SUMMARY

In such aforementioned printers, if the sheet is curled, for example, there may be a case where the sheet on the conveying surface curls upward from the conveyor belt. A sheet tends to curl upward from the conveyor belt frequently especially in the case where the sheet is relatively thick and has elasticity. Depending on the degree of the curl of the sheet, the sheet can possibly rub itself against the ink discharge surfaces. This can cause the ink from the ink discharge surfaces to become adhered to the sheet and thus lead to a waste of the sheet, or can damage the ink discharge surfaces. In addition, this may also lead to jamming of the sheet. Normally, to prevent a sheet from curling upward, the attachment force of the conveyor belt is set relatively high.

However, when a sheet conveyed by the conveyor belt is to be ejected onto the ejection portion, the strong attachment force of the conveyor belt can make it difficult to detach the sheet from the conveyor belt, thus leading to jamming of the sheet.

Accordingly, it would be desirable to provide an image recording apparatus in which a recording medium can be detached easily from an outer periphery surface of a conveyor belt.

In accordance with one aspect, an image recording apparatus includes a recording head that records an image on a recording medium. A conveyor supports the recording medium on an outer surface thereof so as to convey the recording medium in a conveying direction, and has an attachment region and a non-attachment region on its outer surface. The recording medium is attachable to the attachment region with a first attachment force greater than a second attachment force of the non-attachment region. A medium feeder is configured to feed the recording medium to the conveyor so that at least a part of a leading edge of the recording medium in the conveying direction is positioned on the non-attachment region.

Accordingly, in such embodiments, at least a part of the leading edge of the recording medium in the conveying direction does not become attached to the outer surface of the conveyor. This allows the recording medium to be detached easily from the conveyor, thereby minimizing the occurrence of jamming of the recording medium.

In certain embodiments, the attachment region and the non-attachment region may each extend annularly around the outer surface of a conveyor belt between first and second rollers. Accordingly, in such embodiments, the leading edge of the recording medium can be partially disposed on the non-attachment region regardless of the timing at which the recording medium is fed to the conveyor belt. This facilitates the control of the feeding process of the recording medium.

In certain embodiments, the conveyor may include a plurality of non-attachment regions. Moreover, the medium feeder may position the recording medium so that opposite sides of the recording medium extending in the conveying direction are disposed on the non-attachment region. Accordingly, the opposite sides of the recording medium extending in the conveying direction do not become attached to the outer surface of the conveyor belt, whereby the recording medium can be more easily detached from the conveyor.

In other embodiments, the attachment region and the non-attachment region may be alternately arranged in the conveying direction on the conveyor. The image recording apparatus may further include a detector configured to detect a position of at least one of said attachment region and said non-attachment region. Moreover, the medium feeding means may feed the recording medium to the conveyor on the basis of a detection result of the detector so that the leading end of the recording medium is positioned on the non-attachment region. Accordingly, since the leading edge of the recording medium is entirely positioned on the non-attachment region, the recording medium can be more easily detached from the conveyor belt.

In certain embodiments, the detector may be an optical sensor of a reflective type. Accordingly, the detection can be implemented with a simple configuration.

In certain embodiments, the image recording apparatus may further include a plurality of detachment claws for detaching the recording medium supported on the outer surface of the conveyor from the outer surface. In this case, a central detachment claw may comes into contact with the recording medium at a lower position than a position of detachment claws located closest to the opposite sides of the conveyor extending in the conveying direction.

Accordingly, the recording medium conveyed by the conveyor becomes detached from the conveyor by coming into the contact with the detachment claws sequentially from the opposite end sections of the leading edge of the recording medium. This further facilitates the detachment of the recording medium from the conveyor belt.

In certain embodiments, the image recording apparatus may include an adhesive layer on the outer surface of the conveyor, and a non-adhesive sheet bonded to the adhesive layer, wherein a surface of said non-adhesive sheet member defines said non-attachment region, wherein a part of a surface of the adhesive layer that is not covered with said non-adhesive sheet member defines said attachment region.

Alternatively, the image forming apparatus may include an air-flow generating device for generating air flow that allows the recording medium to be attached to the outer surface of the conveyor, a plurality of through holes distributed over the conveyor, and a non-adhesive sheet member bonded to the conveyor, wherein a surface of said non-adhesive sheet member defines said non-attachment region, and wherein a part of the outer surface of the conveyor that is not covered with said non-adhesive sheet member defines said attachment region.

As a further alternative, the image forming apparatus may include a charging device that electrically charges the conveyor belt, and a non-adhesive sheet member bonded to the conveyor and having a lower charge property than a charge property of the outer surface of the conveyor, wherein a surface of said non-adhesive sheet member defines said non-attachment region, and wherein a part of the outer surface of the conveyor that is not covered with said non-adhesive sheet member defines said attachment region.

Accordingly, whether the apparatus applies an adhesion method including an adhesive layer and a non-adhesive sheet member, an air suction method including an air-flow generating device with holes provided in the conveyor, and a non-adhesive sheet member, or a charging method including a charging device and a non-adhesive sheet member having a low charge property, the non-attachment region can be formed readily by bonding the sheet member onto the conveyor.

Certain embodiments of the image recording apparatus may further include a charge-removing device that removes an electrical charge from the conveyor, and a cleaning assembly configured to clean the outer surface of the conveyor. Accordingly, with an electrostatic force of the conveyor in a charged state, the foreign matter adhered to the outer surface of the conveyor can be removed.

In certain embodiments, the surface of the non-adhesive sheet member may have a reflectivity that is different from that of the outer surface of the conveyor. Accordingly, the attachment region not covered with the sheet member and the non-attachment region having the sheet member bonded thereto can be readily distinguished from each other using an optical sensor of a reflective type.

In certain embodiments, a second roller suspending a conveyor belt may have a diameter smaller than that of a first roller. Accordingly, since the periphery of the second roller has a relatively large curvature, the conveyor wound around the second roller curves significantly. Thus, the recording medium can be readily detached from the conveyor belt at the second roller.

BRIEF DESCRIPTION OF THE DRAWINGS

FIG. 7 is a flow chart showing a procedure of processes performed in the printer shown in FIG. 1;

DESCRIPTION OF THE PREFERRED EMBODIMENTS

Preferred embodiments of an image recording apparatus will now be described with reference to the drawings.

First Embodiment

Figure 1:
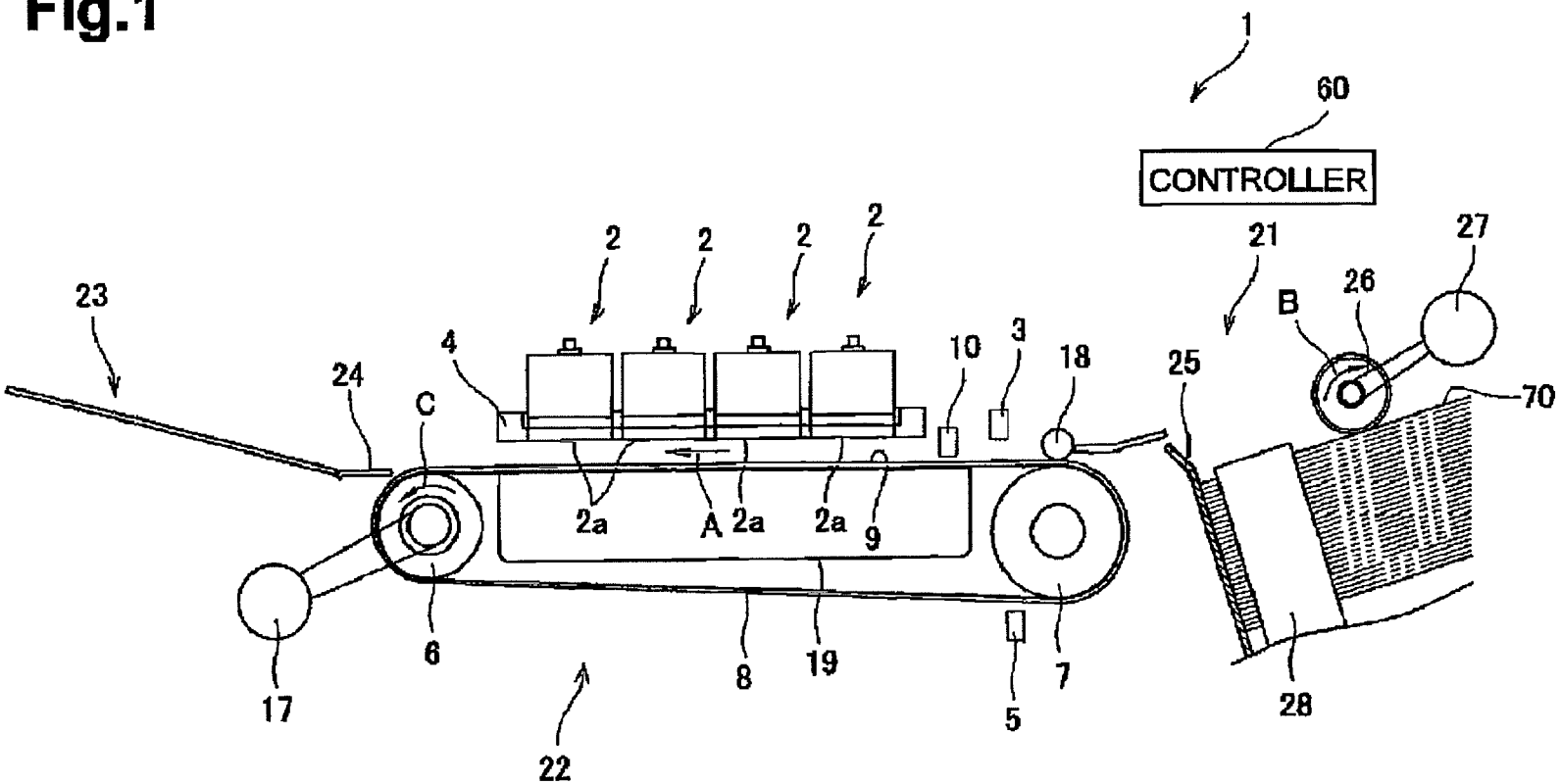
FIG. 1 is a schematic cross-sectional view of a first embodiment of a printer.
Figure 2:
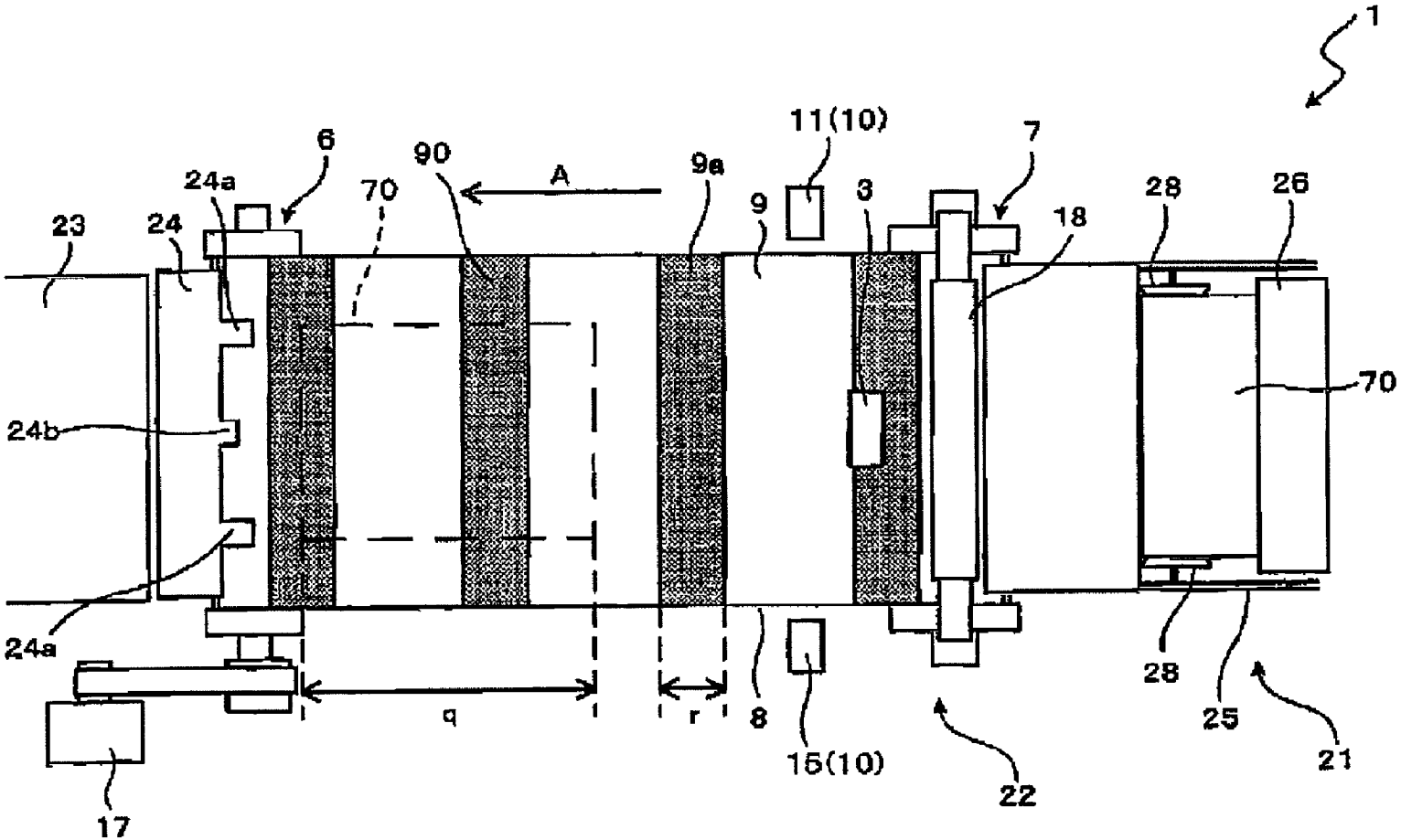
FIG. 2 is a plan view showing the printer shown in FIG. 1 without inkjet heads.
Figure 3:
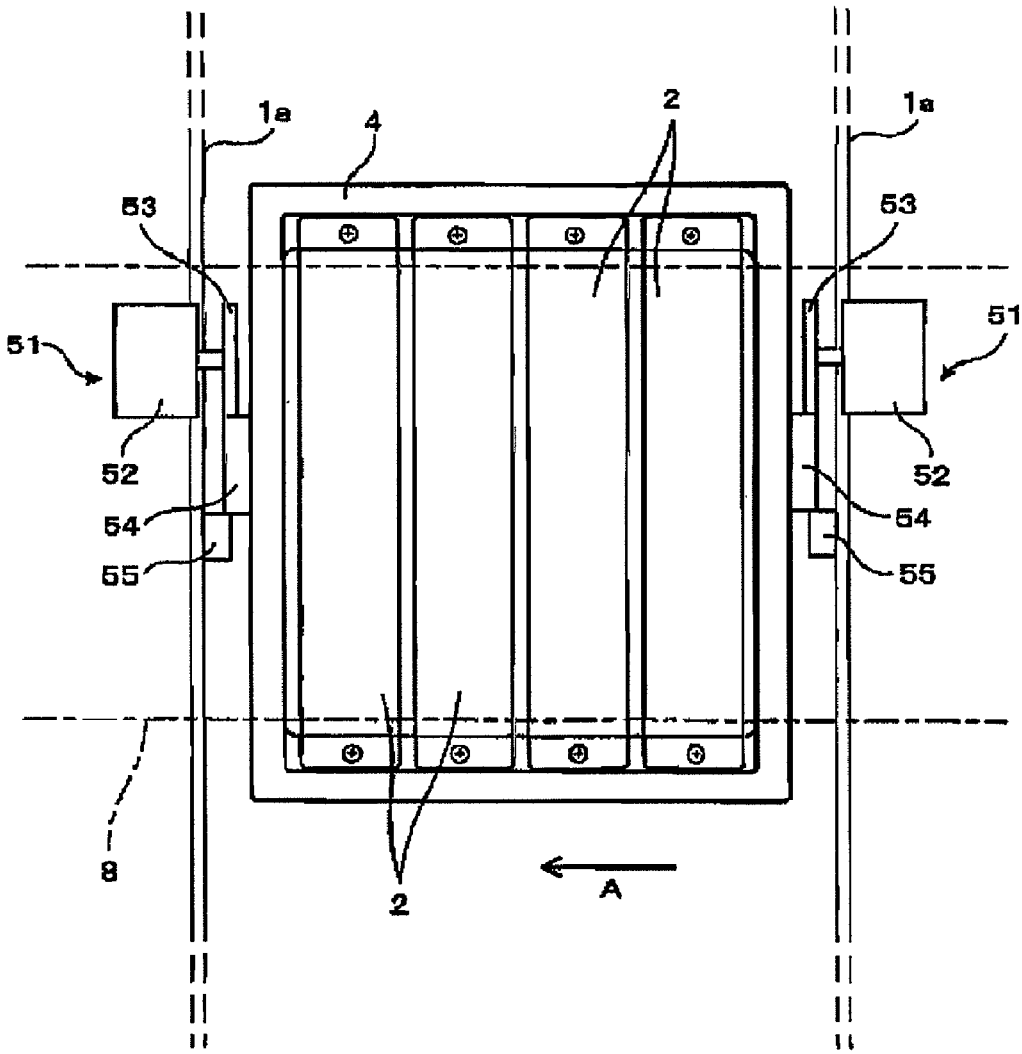
FIG. 3 is a plan view of inkjet heads and the peripheral area thereof shown in FIG. 1.

FIG. 1 is a schematic cross-sectional view of a first embodiment of a printer. FIG. 2 is a plan view showing the printer shown in FIG. 1 without inkjet heads. FIG. 3 is a plan view of four inkjet heads and the peripheral area thereof shown in FIG. 1. Referring to FIG. 1, a printer 1 has four inkjet heads 2 in correspondence with four color inks (magenta, yellow, cyan, and black), each inkjet head 2 having a discharge surface 2*a* provided with a plurality of nozzles (not shown) that discharge ink droplets. In other words, the printer 1 is a color inkjet printer. Moreover, the printer 1 includes a feeder mechanism 21 that feeds sheets 70 housed in a sheet tray 25 one by one, and a conveyor mechanism 22 that conveys each sheet 70 fed by the feeder mechanism 21 while allowing the sheet 70 to face the discharge surfaces 2*a* of the inkjet heads 2. The operation of the printer 1 is controlled by a controller 60.

The four inkjet heads 2 are located above the conveyor mechanism 22. Moreover, as shown in FIGS. 1 and 3, the four inkjet heads 2 are fixed to a frame 4 so as to be adjacent to each other in the conveying direction (i.e. a direction indicated by an arrow A) of the sheets 70. Each inkjet head 2 has a length that corresponds to the width of a sheet 70 of the largest size used in the printer 1, the width extending in a direction perpendicular to the conveying direction (i.e. the direction of the arrow A) of the sheets 70. Specifically, referring to FIG. 3, each inkjet head 2 has a rectangular planar shape that is oblong in the main scanning direction (i.e. the vertical direction in FIG. 3), which is perpendicular to the conveying direction of the sheets 70. In other words, the four inkjet heads 2 are line heads, and the printer 1 is a line printer (line recording apparatus).

The frame 4 may be supported by frame moving mechanisms 51 shown in FIG. 3 in a movable manner in a vertical direction (i.e. a direction perpendicular to the page of FIG. 2). The frame moving mechanisms 51 are disposed at opposite sides of the frame 4 in the conveying direction of the sheets 70 (i.e. the direction of the arrow A). Each frame moving mechanism 51 includes a drive motor 52 serving as a driving source for the vertical movement, a pinion gear 53 fixed to a shaft of the drive motor 52, a rack gear 54 meshed with the pinion gear 53, and a guide 55 disposed at a position where the guide 55 and the pinion gear 53 have the rack gear 54 interposed therebetween. The drive motor 52 may be fixed to a main frame 1*a* of the printer 1, the rack gear 54 may be disposed adjacent to the frame 4, and the guide 55 may be fixed to the main frame 1*a*.

When the two drive motors 52 are synchronized to rotate the respective pinion gears 53 in forward and reverse directions, the rack gears 54 are moved in the vertical direction. In response to this vertical movement of the rack gears 54, the frame 4 and the four inkjet heads 2 move in the vertical direction.

The feeder mechanism 21 may include a pickup roller 26 that feeds the uppermost sheet 70 of the plurality of sheets 70 housed in the sheet tray 25. When the pickup roller 26 is rotated by a drive motor 27 in the clockwise direction in FIG. 1 (i.e. in a direction indicated by an arrow B), the sheet 70 is fed from right to left in FIG. 1. The feeder mechanism 21 may also include a pair of positioning plates 28 for adjusting the position of the sheets 70 housed in the sheet tray 25 relative to the main scanning direction. Referring to FIG. 2, the positioning plates 28 may be disposed within the sheet tray 25 and abut on opposite sides of the sheets 70 stacked in the sheet tray 25, the opposite sides extending in the conveying direction (i.e. the direction of the arrow A). In the first embodiment, the positioning plates 28 position each sheet 70 so as to align a midsection of the sheet 70 in the main scanning direction with a midsection of a conveyor belt 8 in the main scanning direction.

As shown in FIG. 2, the conveyor mechanism 22 may include belt rollers 6 and 7 having rotary shafts that are parallel to each other, and an endless conveyor belt 8 suspended between the belt rollers 6 and 7. The belt roller 6 is located at a downstream side in the conveying direction (i.e. the direction of the arrow A) of the sheets 70, namely, at the left side in FIGS. 1 and 2, and is rotated counterclockwise in FIG. 1 (i.e. a direction indicated by an arrow C) by a drive motor 17. Referring to FIG. 1, the belt roller 6 has a diameter that is smaller than that of the belt roller 7. In an area surrounded by the conveyor belt 8 is disposed a platen 19, having a substantially rectangular parallelepiped shape in the illustrated embodiment, which supports the conveyor belt 8 at the inner periphery surface thereof.

The conveyor belt 8 may be formed of a base material composed of rubber such as ethylene-propylene rubber (EPDM), whose surface may be given a silicon treatment to form an adhesive layer thereon. The adhesive layer defines the outer periphery surface, that is, a conveying surface 9, of the conveyor belt 8. As shown in FIG. 2, the conveying surface 9 may have bonded thereon a plurality of non-adhesive films 9*a*. Each film 9*a* extends to the opposite sides of the conveyor belt 8 in the width direction thereof (i.e. the direction perpendicular to the conveying direction of the sheets 70). The plurality of films 9*a* may be bonded so as to be arranged at a predetermined interval in the conveying direction of the sheets 70 (i.e. the direction of the arrow A in FIG. 2). Accordingly, the conveying surface 9 may have alternately arranged thereon in the conveying direction of the sheets 70 non-attachment regions where the films 9*a* are bonded and attachment regions where the films 9*a* are not bonded. Specifically, when a sheet 70 is placed on the conveying surface 9, the sheet 70 does not attach itself to the non-attachment regions but does attach itself to the attachment regions due to the adhesive force. In other words, the adhesive layer and the films 9*a* constituting the conveying surface 9 correspond to attachment means for defining the attachment regions and the non-attachment regions on the conveying surface 9. The non-attachment regions may have some adhesiveness as long as the adhesiveness is smaller than that of the attachment regions. In the first embodiment, the films 9*a* are silver-color films having light reflecting properties.

Referring to FIG. 2, each film 9*a* has a width r (i.e. a length in the conveying direction of the sheets 70) that may be smaller than or equal to half the length q of the smallest kind of sheet 70 used in the printer 1 in the conveying direction. This ensures that a sheet 70 of the smallest kind can be conveyed while being properly attached to the attachment regions.

Directly downstream of the feeder mechanism 21 may be disposed a pressing roller 18 at a position facing the conveyor belt 8. The pressing roller 18 presses the sheet 70 fed from the feeder mechanism 21 against the conveying surface 9 of the conveyor belt 8. Consequently, the sheet 70 fed by the pickup roller 26 may be conveyed downstream in the conveying direction while being pressed against the conveying surface 9 by the pressing roller 18 and held by the adhesive force of the attachment regions on the conveying surface 9.

Furthermore, a leading-edge sensor 3 may be provided between the pressing roller 18 and the inkjet heads 2, or namely, located upstream of the inkjet heads 2. The leading-edge sensor 3 may be an optical sensor of a reflective type, which emits light towards a detection position on the conveying surface 9 and detects the amount of reflected light. Based on a detection signal output from the leading-edge sensor 3, it can be detected whether or not the leading edge of the sheet 70 conveyed on the conveying surface 9 has reached the detection position of the leading-edge sensor 3.

Figure 4:
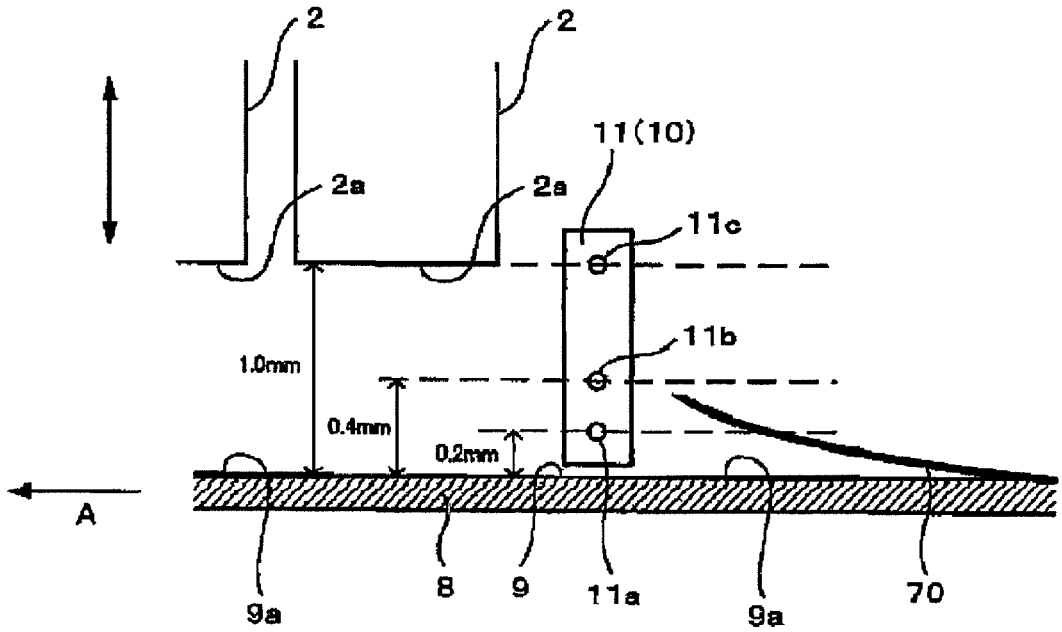
FIG. 4 illustrates a separation sensor shown in FIG. 1.

The leading-edge sensor 3 and the inkjet heads 2 may have a separation sensor 10 provided therebetween. The separation sensor 10 detects a distance by which the leading edge of the sheet 70 is separated from the conveying surface 9. Referring also to FIG. 4, the separation sensor 10 will now be described. The separation sensor 10 may be an optical sensor of a transmissive type and may be constituted by a light emitting unit 11 and a light receiving unit 15 as shown in FIG. 2. As viewed in the main scanning direction (i.e. the vertical direction in FIG. 2) that is perpendicular to the conveying direction (i.e. the direction of the arrow A), the light emitting unit 11 and the light receiving unit 15 are disposed opposite to each other across the conveying path of the sheets 70. Since it is desirable that the emitted light does not diffuse in the course of traveling from the light emitting unit 11 to the light receiving unit 15, the separation sensor 10 may use laser beams. However, the separation sensor 10 does not necessarily have to be an optical sensor that uses laser beams, and may be an alternative sensor that is capable of detecting the separated distance of the leading edge of a sheet 70 from the conveying surface 9.

Referring to FIG. 4, the light emitting unit 11 may include three light emitting elements 11*a*, 11*b*, and 11*c* arranged in that order from the conveying surface 9, as viewed in the direction perpendicular to the conveying surface 9. In detail, the light emitting elements 11*a*, 11*b*, and 11*c* are disposed apart from the conveying surface 9 by 0.2 mm, 0.4 mm, and 1.0 mm, respectively. The light emitting elements 11*a*, 11*b*, and 11*c* all emit light beams in the main scanning direction. Specifically, the light beam emitted from the light emitting element 11*a* is at the lowest height (i.e. a lowest positional level from the conveying surface 9), the light beam emitted from the light emitting element 11*b* is at the intermediate height level, and the light beam emitted from the light emitting element 11*c* is at the highest height (i.e. a highest positional level from the conveying surface 9). In the description below, the height level from the conveying surface 9 to the light beam of the light emitting element 11*a* will be referred to as a "first distance", the height level from the conveying surface 9 to the light beam of the light emitting element 11*b* will be referred to as a "second distance", and the height level from the conveying surface 9 to the light beam of the light emitting element 11*c* will be referred to as a "third distance". The light receiving unit 15 may have three light receiving elements (not shown) that respectively receive the light beams emitted from the light emitting elements 11*a*, 11*b*, and 11*c*.

Accordingly, if all of the light beams emitted from the light emitting elements 11*a*, 11*b*, and 11*c* are received by the light receiving elements without any interception, the separation sensor 10 can detect that the separated distance of the leading edge of the sheet 70 from the conveying surface 9 is in a range between zero and the first distance (which will be referred to as a "first predetermined range" hereinafter). If only the light beam of the light emitting element 11*a* is intercepted, the separation sensor 10 can detect that the separated distance of the sheet 70 is within a range between the first distance and the second distance (which will be referred to as a "second predetermined range" hereinafter). If at least the light beam of the light emitting element 11*b* out of the light beams emitted from the light emitting element 11*a* and the light emitting element 11*b* is intercepted whereas the light beam of the light emitting element 11*c* is not intercepted, the separation sensor 10 can detect that the separated distance of the sheet 70 is within a range between the second distance and the third distance (which will be referred to as a "third predetermined range" hereinafter). If at least the light beam of the light emitting element 11*c* out of the light beams emitted from the light emitting elements 11*a*, 11*b*, and 11*c* is intercepted, the separation sensor 10 can detect that the separated distance of the sheet 70 is within a range above or equal to the third distance (which will be referred to as a "fourth predetermined range" hereinafter). Based on an output signal from the separation sensor 10, the distance by which the sheet 70 is separated from the conveying surface 9 can be detected at four different levels.

Referring to FIG. 1, an ejection tray 23 may be provided downstream of the conveyor mechanism 22 in the conveying direction (i.e. the direction of the arrow A). The conveyor belt 8 and the ejection tray 23 may have a detachment plate 24 disposed therebetween. The detachment plate 24 detaches the sheet 70 held on the conveying surface 9 from the conveying surface 9 and guides the sheet 70 towards the ejection tray 23. Referring to FIG. 2, the detachment plate 24 may have detachment claws 24*a* and 24*b* projecting therefrom in a direction extending from the ejection tray 23 towards the conveyor belt 8 (i.e. from left to right in FIG. 2). The detachment claws 24*a* and 24*b* detach the sheet 70 from the conveying surface 9 at a position where the claws overlap the belt roller 6 with respect to the conveying direction. The tip ends of the detachment claws 24*a* and 24*b* may be disposed close to the conveying surface 9 with a slight gap between the tip ends and the conveying surface 9. As viewed in the axial direction of the rotary shaft of the belt roller 6 (i.e. the vertical direction in FIG. 2), the detachment claw 24*b* may be located in the center of the conveyor belt 8, and the detachment claws 24*a* may be provided at opposite sides of the detachment claw 24*b*.

Figure 5A:
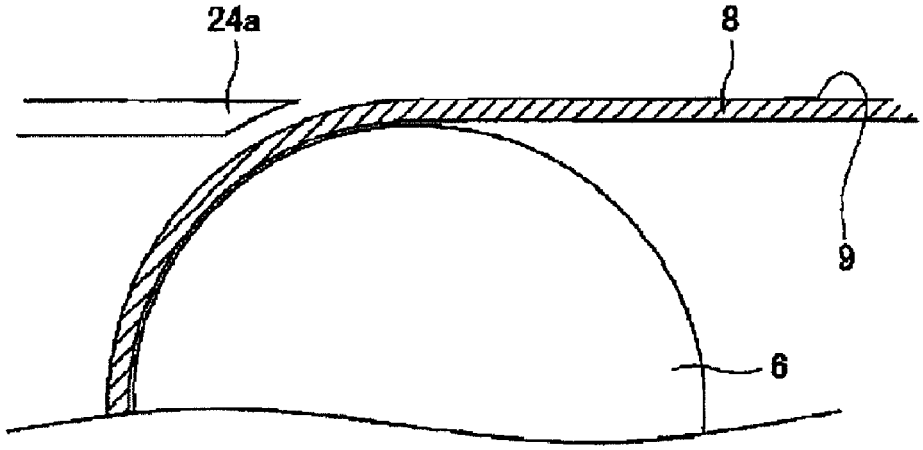
FIG. 5 is an enlarged view of detachment claws of a detachment plate shown in FIG. 1.
Figure 5B:
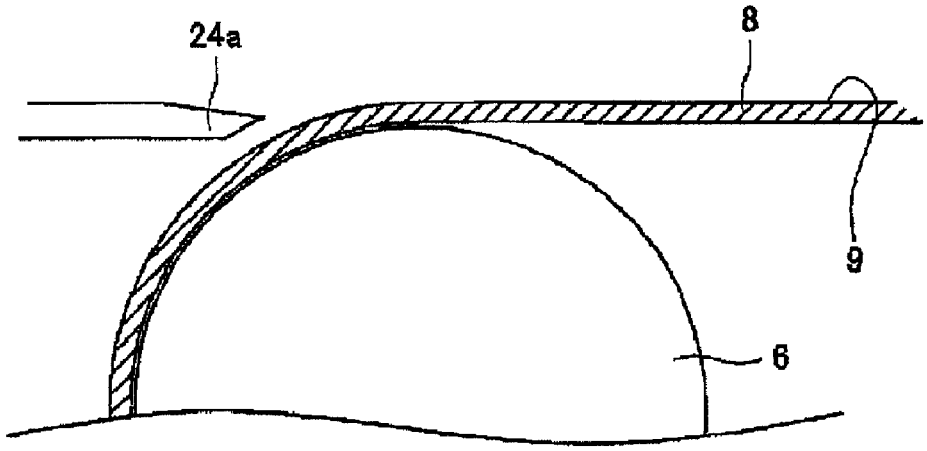

FIGS. 5A and 5B are side views of the detachment claws 24*a* and 24*b*. Referring to FIG. 5A, the upper surface of each detachment claw 24*a* may be at substantially the same height as a section of the conveying surface 9 where the conveyor belt 8 is in contact with the belt roller 6. The height of this section of the conveying surface 9 will be referred to as a "conveyance height" hereinafter. On the other hand, referring to FIG. 5B, although the height of the upper surface of the detachment claw 24*b* may be substantially aligned with the conveyance height like the detachment claw 24*a*, the detachment claw 24*b* may have a tapered end. For this reason, the end of the detachment claw 24*b* may be positioned lower than the conveyance height. Therefore, when the sheet 70 is held on the conveying surface 9 and is conveyed to an area near the belt roller 6 while the midsection of the sheet 70 and the midsection of the conveyor belt 8 in the main scanning direction are aligned with each other by the positioning plates 28 as mentioned above, the opposite end sections of the leading edge of the sheet 70 in the conveying direction come into contact with the two detachment claws 24*a* at the conveyance height. This causes the opposite end sections of the leading edge of the sheet 70 to become detached from the conveying surface 9. Subsequently, the midsection of the leading edge of the sheet 70 comes into contact with the detachment claw 24*b* at a position lower than the conveyance height, whereby the leading edge of the sheet 70 becomes entirely detached from the conveying surface 9.

Referring to FIG. 1, a film sensor 5 for detecting the films 9*a* bonded to the conveying surface 9 of the conveyor belt 8 may be provided underneath the conveyor belt 8. The film sensor 5 may be a reflective-type sensor that emits light towards a detection position on the conveying surface 9 and detects the amount of reflected light. Since the films 9*a* may be silver-colored as mentioned above, the non-attachment regions with the films 9*a* and the attachment regions without the films 9*a* may have different light reflectivity. Therefore, when a non-attachment region reaches the detection position, the amount of reflected light increases. Accordingly, based on a detection signal output from the film sensor 5, it can be detected whether or not a non-attachment region of the conveying surface 9 has reached the detection position of the film sensor 5.

The controller 60 will now be described. The controller 60 may contain hardware, such as a CPU, a ROM, a RAM, and a hard disk. The hard disk may store various software programs including a program for controlling the overall operation of the printer 1. With the combination of the hardware and the software, the following portions 61 to 68 (see FIG. 6) are established.

Figure 6:
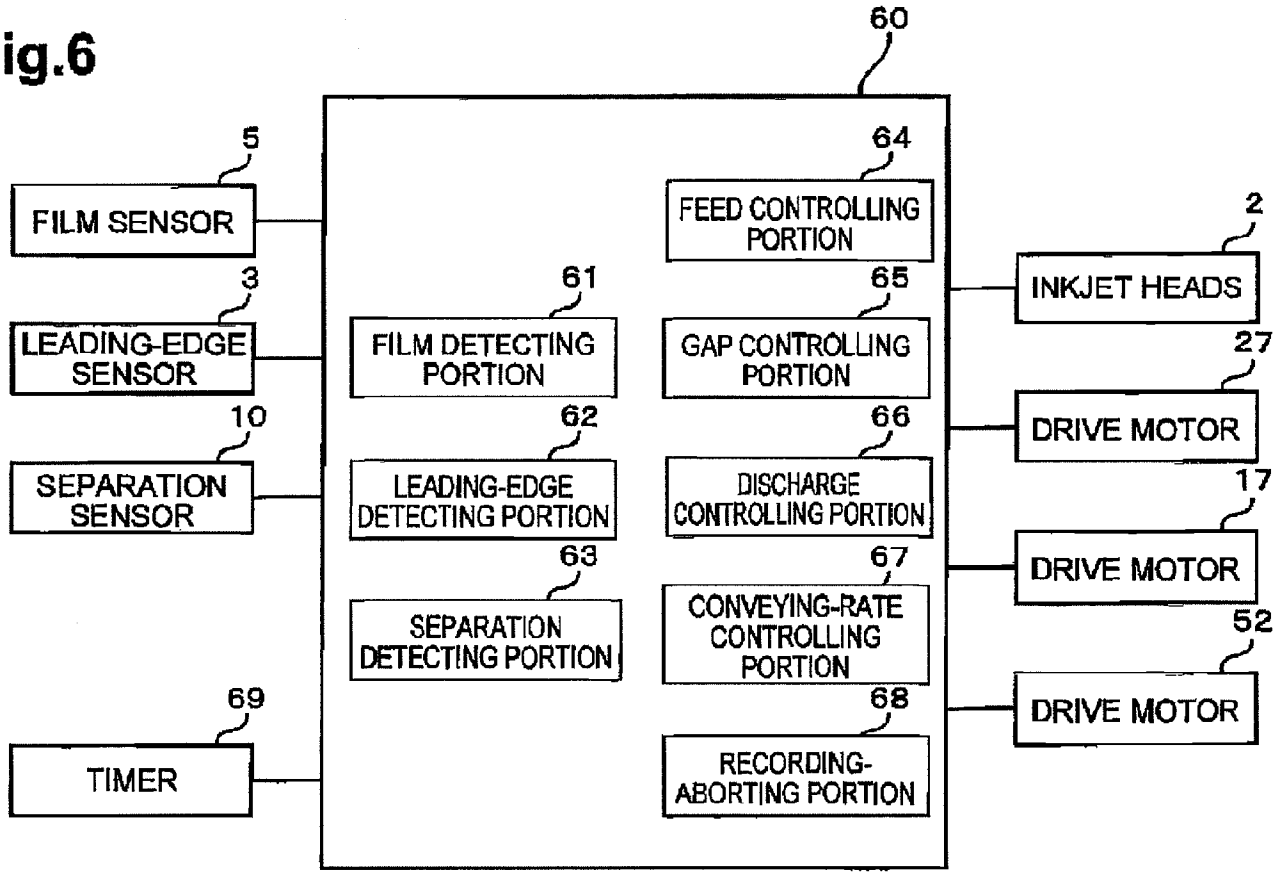
FIG. 6 is a schematic block diagram of a controller shown in FIG. 1.

Referring to FIG. 6 which is a schematic block diagram of the controller 60, the controller 60 may include a film detecting portion 61, a leading-edge detecting portion 62, a separation detecting portion 63, a feed controlling portion 64, a gap controlling portion 65, a discharge controlling portion 66, a conveying-rate controlling portion 67, and a recording-aborting portion 68. The controller 60 may be connected to the inkjet heads 2, the drive motor 27 for rotating the pickup roller 26, the drive motor 17 for rotating the belt roller 6, the drive motors 52 of the frame moving mechanisms 51, the film sensor 5, the leading-edge sensor 3, and the separation sensor 10. The controller 60 may also connected to a timer 69 that outputs a clock signal.

The film detecting portion 61 may detect whether or not a non-attachment region defined by a film 9*a* bonded on the conveying surface 9 has reached the detection position of the film sensor 5 on the basis of an output signal from the film sensor 5.

The leading-edge detecting portion 62 may detect whether or not the leading edge of a sheet 70 held on and conveyed by the conveying surface 9 has reached the detection position of the leading-edge sensor 3 on the basis of an output signal from the leading-edge sensor 3. More specifically, the leading-edge detecting portion 62 may receive an output signal from the leading-edge sensor 3 during a leading-edge detecting period of a predetermined time length measured by the timer 69, so as to detect the leading edge of the sheet 70.

The separation detecting portion 63 may detect a distance by which a sheet 70 is separated from the conveying surface 9 at four different levels (i.e. first predetermined range to fourth predetermined range) on the basis of an output signal from the separation sensor 10. More specifically, the separation detecting portion 63 may receive an output signal from the separation sensor 10 during a separation detecting period of a predetermined time length measured by the timer 69, so as to detect the separated distance of the sheet 70. A separation detecting period starts when the leading edge of the sheet 70 is detected by the leading-edge detecting portion 62.

The feed controlling portion 64 may control the driving of the drive motor 27 for rotating the pickup roller 26, so as to control the timing at which a sheet 70 is fed from the sheet tray 25. In detail, the feed controlling portion 64 may allow a sheet 70 to be fed at a predetermined timing after a non-attachment region defined by a film 9*a* bonded to the conveying surface 9 has been detected by the film detecting portion 61, so that the leading edge of the sheet 70 in the conveying direction (i.e. the direction of the arrow A) can be positioned on the non-attachment region, as shown with a chain line in FIG. 2. Accordingly, since the leading edge of the sheet 70 is not attached to the conveying surface 9, the detachment plate 24 can readily detach the sheet 70 from the conveying surface 9.

The gap controlling portion 65 may control the driving of the drive motors 52 of the frame moving mechanisms 51, which move the frame 4 securely holding the inkjet heads 2 in the vertical direction, so as to control the gap between the discharge surfaces 2*a* and the conveying surface 9. Specifically, based on the detection result of the separated distance of the sheet 70 by the separation detecting portion 63, the gap controlling portion 65 allows the inkjet heads 2 to move in the vertical direction in order to control the gap. In the initial state, the gap may be set at 1.0 mm. If the separated distance detected by the separation detecting portion 63 is within the first predetermined range, the gap does not undergo any changes. If the separated distance is detected to be within the second predetermined range, the gap may be increased to 1.2 mm. If the separated distance is detected to be within the third predetermined range, the gap may be increased to 2.0 mm. In this manner, the gap is increased with increasing separated distance, thereby allowing the inkjet heads 2 to properly perform an image recording operation while preventing the sheet 70 from coming into contact with the discharge surfaces 2*a*.

The discharge controlling portion 66 may control the discharge timing of ink droplets from the nozzles (not shown) of the inkjet heads 2 and also control the minimum volume of ink droplets to be discharged. Specifically, when the frame moving mechanisms 51 controlled by the gap controlling portion 65 complete an upward movement of the inkjet heads 2, the discharge controlling portion 66 may control the inkjet heads 2 so that ink droplets are discharged from the nozzles. In addition, based on the detection result of the separated distance of the sheet 70 by the separation detecting portion 63, the discharge controlling portion 66 may control the minimum volume of ink droplets. In other words, if the separated distance detected by the separation detecting portion 63 is within the first predetermined distance, the minimum volume of ink droplets may be set at 2 pL. If the separated distance is detected to be within the second predetermined distance or the third predetermined distance and the gap is increased to a value greater than or equal to the initial-state value of 1.0 mm, the minimum volume of ink droplets may be increased to 5 pL.

A mist of ink droplets that scatter without landing on a sheet 70 tends to occur more easily as the volume of ink droplets discharged from the nozzles becomes smaller or as the gap between the discharge surfaces 2*a* and the conveying surface 9 becomes greater. As described above, in the first embodiment, the minimum volume of ink droplets may be increased as the gap becomes greater. Accordingly, this minimizes the occurrence of a mist of ink droplets.

The conveying-rate controlling portion 67 may control the driving of the drive motor 17 for rotating the belt roller 6, so as to control the conveying rate of the sheet 70 conveyed by the conveyor belt 8. More specifically, the conveying-rate controlling portion 67 may control the conveying rate of the sheet 70 on the basis of the detection result of the separated distance of the sheet 70 by the separation detecting portion 63. In the initial state, the conveying rate of a sheet 70 may be set at 600 mm/sec. If the separated distance detected by the separation detecting portion 63 is within the first predetermined range or the second predetermined range, the conveying rate of the sheet 70 does not undergo any changes. If the separated distance is detected to be within the third predetermined distance, the rotation rate of the belt roller 6 may be reduced so as to lower the conveying rate of the sheet 70 to 300 mm/sec.

The recording-aborting portion 68 may abort the controlling of the inkjet heads 2 by the discharge controlling portion 66 when the separated distance detected by the separation detecting portion 63 is within the fourth predetermined distance, so as to prevent ink droplets from landing on the sheet 70.

A procedure of an image recording operation performed by the printer 1 will now be described while referring to FIG. 7 showing a flow chart of processes performed in the printer 1.

In step S1, the film sensor 5 performs a detection process. Specifically, the film sensor 5 emits a light beam towards a detection position on the conveying surface 9 and outputs an output signal indicating the amount of reflected light of the light beam to the film detecting portion 61. In step S2, the film detecting portion 61 determines whether or not a non-attachment region is detected. In detail, the film detecting portion 61 determines whether there is an increase in the amount of reflected light based on the fact that the amount of reflected light increases when a silver-colored film 9*a* bonded to a non-attachment region reaches the detection position.

If it is determined that a non-attachment region has not reached the detection position (S2: NO), the operation returns to step S1 where the detection process by the film sensor 5 is repeated. On the other hand, if it is determined that a non-attachment region has reached the detection position (S2: YES), the operation proceeds to step S3 where the feed controlling portion 64 performs control to allow a sheet 70 to be fed from the sheet tray 25 in a manner such that the leading edge of the sheet 70 in the conveying direction is positioned on the non-attachment region. In step S4, the leading-edge detecting portion 62 starts to detect the leading edge of the sheet 70. At the same time, the timer 69 starts to measure a leading-edge detecting period for a predetermined time length. In step S5, it is determined whether or not the leading edge of the sheet 70 has been detected.

If the leading edge of the sheet 70 is not detected (S5: NO), the operation proceeds to step S6 where it is determined whether or not the leading-edge detecting period has elapsed. If it is determined that the leading-edge detecting period has not yet elapsed (S6: NO), the determination process in step S5 is performed again. On the other hand, if it is determined that the leading-edge detecting period has elapsed (S6: YES), namely, if the leading edge of the sheet 70 is not detected within the leading-edge detecting period, the operation proceeds to step S7 where the conveyor belt 8 stops conveying the sheet 70. In this case, it can be assumed that either the sheet tray 25 is empty or the sheet 70 is jammed somewhere along the path between the sheet tray 25 and the detection position of the leading-edge sensor 3.

If the leading edge of the sheet 70 is detected in step S5 (S5: YES), the operation proceeds to step S8 where the separation sensor 10 starts to detect the separated distance. In other words, the light emitting elements 11*a*, 11*b*, and 11*c* start to emit light beams therefrom. At the same time, the timer 69 is reset and starts to measure a separation detecting period for a predetermined time length.

In step S9, it is determined whether any of the light beams emitted from the three light emitting elements 11*a*, 11*b*, and 11*c* is intercepted by the sheet 70. If none of the light beams is intercepted (S9: NO), the operation skips step S10 to be described below and proceeds to step S11. On the other hand, if at least one of the light beams is intercepted (S9: YES), the operation proceeds to step S10 where an output signal indicating which of the light beams emitted from the light emitting elements 11*a*, 11*b*, and 11*c* has been intercepted is sent to the separation detecting portion 63. In step S11, it is determined whether or not the separation detecting period has elapsed.

If it is determined that the separation detecting period has not yet elapsed (S11: NO), the determination process in step S9 is performed again. On the other hand, if it is determined that the separation detecting period has elapsed (S11: YES), the operation proceeds to step S12 where the emission of the light beams from the light emitting elements 11*a*, 11*b*, and 11*c* is stopped to terminate the detection process by the separation sensor 10. In other words, the determination process in step S9 is repeated until the separation detecting period elapses. Subsequently, in step S13, the separation detecting portion 63 determines the level of separated distance on the basis of the output signal sent from the separation sensor 10 during the separation detecting period. In other words, if the separation detecting portion 63 does not receive an output signal from the separation sensor 10, the separation detecting portion 63 determines that the level of separated distance is within the first predetermined range. If the separation detecting portion 63 only receives an output signal indicating that the light beam from the light emitting element 11*a* is intercepted, the separation detecting portion 63 determines that the level of separated distance is within the second predetermined range. If the separation detecting portion 63 receives an output signal indicating that at least the light beam from the light emitting element 11*b* of the light beams from the light emitting elements 11*a* and 11*b* is intercepted and the light beam from the light emitting element 11*c* is not intercepted, the separation detecting portion 63 determines that the level of separated distance is within the third predetermined range. If the separation detecting portion 63 receives an output signal indicating that at least the light beam from the light emitting element 11*c* of all the light beams from the light emitting elements 11*a*, 11*b*, and 11*c* is intercepted, the separation detecting portion 63 determines that the level of separated distance is within the fourth predetermined range.

In step S14, the gap controlling portion 65, the discharge controlling portion 66, the conveying-rate controlling portion 67, and the recording-aborting portion 68 perform an adjustment process on the basis of the determination result in step S13. In detail, if the level of separated distance of the sheet 70 is determined to be within the first predetermined range in step S13, the discharge controlling portion 66 sets the minimum volume of ink droplets to 2 pL. If the level of separated distance of the sheet 70 is determined to be within the second predetermined range, the gap controlling portion 65 allows the gap between the discharge surfaces 2*a* and the conveying surface 9 to be increased from 1.0 mm corresponding to the initial state to 1.2 mm, and the discharge controlling portion 66 sets the minimum volume of ink droplets to 5 pL. If the level of separated distance of the sheet 70 is determined to be within the third predetermined range, the gap controlling portion 65 allows the gap to be increased to 2.0 mm, the discharge controlling portion 66 sets the minimum volume of ink droplets to 5 pL, and the conveying-rate controlling portion 67 reduces the conveying rate of the sheet 70 from 600 mm/sec corresponding to the initial state to 300 mm/sec. If the level of separated distance of the sheet 70 is determined to be within the fourth predetermined range, the recording-aborting portion 68 aborts the controlling of the inkjet heads 2 by the discharge controlling portion 66 so as to prevent a recording operation from being performed on the sheet 70.

When the adjustment process in step S14 is completed, the operation proceeds to step S15 where the discharge controlling portion 66 controls the inkjet heads 2 to allow ink droplets to be discharged therefrom, so that an image is recorded on the sheet 70.

In the first embodiment, the aforementioned steps S8 to S14 may be performed for every sheet. In other words, every time a sheet 70 is fed from the sheet tray 25, the aforementioned steps S8 to S14 are performed in order to adjust the gap between the discharge surfaces 2*a* and the conveying surface 9, the conveying rate of the sheet 70, and the minimum volume of ink droplets in accordance with the separated distance of the sheet 70 at the detection position of the separation sensor 10. However, there may be a case where all of the sheets 70 housed in the sheet tray 25 are curled. In that case, if print jobs of multiple sheets are sent to the printer 1, the aforementioned steps S8 to S14 may be implemented only at the time of a printing operation for the first sheet, and a printing operation for a second sheet onward may be performed continuously while maintaining that state. In other words, the aforementioned steps S8 to S14 may be omitted at the time of the printing operation performed for the second sheet onward.

Figure 8:
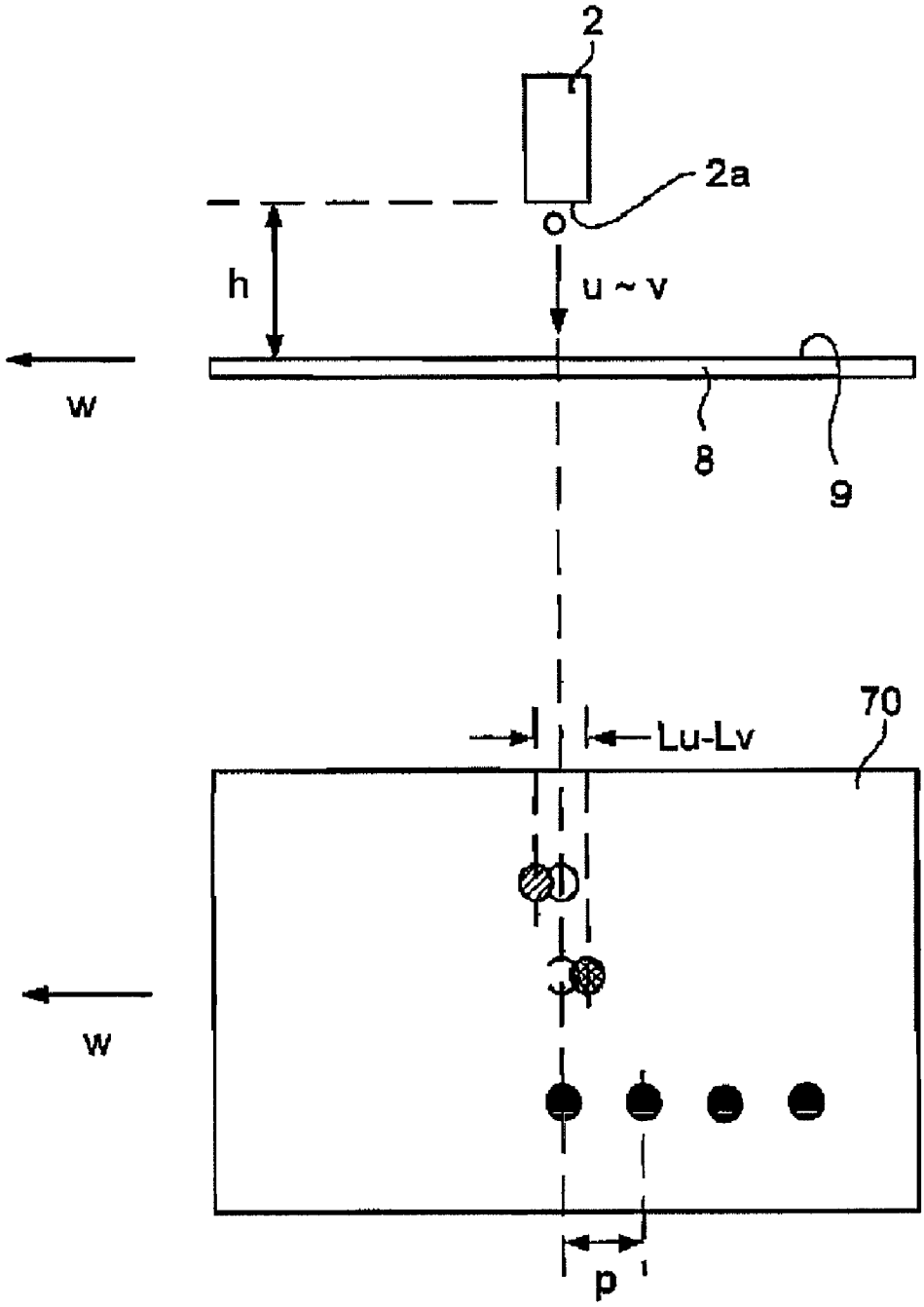
FIG. 8 illustrates landing-position displacement caused by variations in the speed of ink droplets in the printer shown in FIG. 1.

Normally, there is a slight time lag in the speed of ink droplets discharged from the inkjet heads 2. In the first embodiment, the ink droplets may be discharged at a minimum speed of about 9 m/sec and a maximum speed of about 11 m/sec. Due to this difference in speed of ink droplets, the landing positions of the ink droplets on a sheet 70 vary in the conveying direction thereof. FIG. 8 illustrates a desired landing position of an ink droplet indicated by a range surrounded by a chain line, a landing position of an ink droplet at a maximum speed indicated by a single-hatched area, and a landing position of an ink droplet at a minimum speed indicated by a cross-hatched area. As shown in FIG. 8, an ink droplet discharged at high speed lands closer towards the leading edge of the sheet 70 in the conveying direction (i.e. towards the left side) relative to the desired landing position. In contrast, an ink droplet discharged at low speed lands closer towards the trailing edge of the sheet 70 in the conveying direction (i.e. towards the right side) relative to the desired landing position.

Referring to FIG. 8, a difference (Tu−Tv) in time that takes for an ink droplet at minimum speed and an ink droplet at maximum speed to reach the sheet 70 and an amount of displacement (Lu−Lv) between landing positions are expressed with the following expressions (1) and (2):

$$Tu - Tv = h\left(\frac{1}{u} - \frac{1}{v}\right) \quad \text{Expression (1)}$$

$$Lu - Lv = w \times (Tu - Tv) \quad \text{Expression (2)}$$

where w indicates the conveying rate of the sheet 70, u indicates a minimum speed of the ink droplets, v indicates a maximum speed of the ink droplets, and h indicates a gap between the discharge surfaces 2*a* and the conveying surface 9.

For example, if the conveying rate w of the sheet 70 is 600 mm/sec in the initial state and the gap h between the discharge surfaces 2*a* and the conveying surface 9 is 1.0 mm in the initial state, the difference (Tu−Tv) in time that takes for an ink droplet at a minimum speed u of 9 m/sec and an ink droplet at a maximum speed v of 11 m/sec to reach the sheet 70 is determined to be 0.00002 sec from the aforementioned expression (1). The amount of displacement (Lu−Lv) between landing positions is determined to be 0.012 mm from the aforementioned expression (2).

The inkjet heads 2 according to the first embodiment perform image formation at 600 dots per inch (dpi). Consequently, supposing that there is no displacement between landing positions of ink droplets, an interval p of dots arranged linearly in the conveying direction of the sheet 70, as shown with black circles in FIG. 8, is 0.042 mm. Therefore, when the amount of displacement (Lu−Lv) between landing positions is 0.012 mm, the degree of displacement is 28.5%.

On the other hand, when the level of separated distance of the sheet 70 is within the third predetermined range and the gap h between the discharge surfaces 2*a* and the conveying surface 9 is increased to 2.0 mm, if the conveying rate w of the sheet 70 remains at 600 mm/sec in the initial state, the difference (Tu−Tv) in time that takes for an ink droplet at a minimum speed u of 9 m/sec and an ink droplet at a maximum speed v of 11 m/sec to reach the sheet 70 is determined to be 0.00004 sec from the aforementioned expression (1). The amount of displacement (Lu−Lv) between landing positions is determined to be 0.024 mm from the aforementioned expression (2). In this case, the degree of displacement is 57.1%.

As mentioned above, when the gap h between the discharge surfaces 2*a* and the conveying surface 9 is increased, the amount of displacement (Lu−Lv) between landing positions caused by variations in the speed of ink droplets increases in proportion to the gap h, thus deteriorating the image formed by the printer 1. It is apparent from expression (2) that the amount of displacement (Lu−Lv) between landing positions is also proportional to the conveying rate w of the sheet 70. Therefore, an increase in the amount of displacement (Lu−Lv) between landing positions occurring in response to an increase in the gap h can be minimized by reducing the conveying rate w of the sheet 70.

Specifically, when the gap h is increased to 2.0 mm, if the conveying rate w of the sheet 70 is reduced from 600 mm/sec corresponding to the initial state to 300 mm/sec, the difference (Tu−Tv) in time that takes for an ink droplet at a minimum speed u of 9 m/sec and an ink droplet at a maximum speed v of 11 m/sec to reach the sheet 70 is determined to be 0.00004 sec from the aforementioned expression (1). The amount of displacement (Lu−Lv) between landing positions is determined to be 0.012 mm from the aforementioned expression (2). In this case, the degree of displacement is 28.5%, which is the same as the case where the gap h and the conveying rate w are in the initial state.

Accordingly, in the printer 1 of the first embodiment, an image forming operation may be performed by conveying a sheet 70 with the conveyor belt 8 suspended between the two belt rollers 6 and 7 while the sheet 70 is disposed facing the discharge surfaces 2*a* of the inkjet heads 2. The conveying surface 9 of the conveyor belt 8 may have alternately arranged thereon in the conveying direction of the sheets 70 attachment regions to which a sheet 70 is attached and non-attachment regions having an attachment force smaller than that of the attachment regions. The pickup roller 26 may feed each sheet 70 from the sheet tray 25 so as to position the leading edge of the sheet 70 in the conveying direction on a non-attachment region. Therefore, the leading edge portion of the sheet 70 in the conveying direction does not become attached to the conveying surface 9. This allows the sheet 70 to be detached from the conveyor belt 8 easily, thereby minimizing the occurrence of jamming of the sheet 70. In addition, since the leading edge of the sheet 70 is entirely positioned on a non-attachment region, the sheet 70 can be detached from the conveyor belt 8 more easily as compared to a case where only a part of the leading edge is positioned on a non-attachment region.

Because the leading edge portion of the sheet 70 does not become attached to the conveying surface 9 in the first embodiment, the sheet 70 may tend to curl upward from the conveying surface 9. However, the gap controlling portion 65 may control the frame moving mechanisms 51 so as to increase the gap between the discharge surfaces 2*a* of the inkjet heads 2 and the conveying surface 9 in accordance with the distance by which the leading edge of the sheet 70 is separated from the conveying surface 9. This allows the inkjet heads 2 to properly perform an image recording operation while preventing the sheet 70 and the discharge surfaces 2*a* from coming into contact with each other.

Furthermore, the printer 1 according to the first embodiment may be equipped with a film sensor 5 which may be a reflective-type optical sensor that can detect a non-attachment region of the conveying surface 9. Accordingly, the detection of a non-attachment region can be implemented with a simple configuration.

Moreover, the printer 1 according to the first embodiment may be equipped with detachment claws 24*a* and 24*b* at positions where they overlap the belt roller 6 with respect to the conveying direction. The detachment claws 24*a* and 24*b* may be provided for detaching a sheet 70 supported on the conveying surface 9 from the conveying surface 9. As viewed in the axial direction of the rotary shaft of the belt roller 6, the detachment claw 24*b* may be positioned in the center of the conveyor belt 8, and the detachment claws 24*a* may be provided at opposite sides of the detachment claw 24*b*. A contact position of the detachment claw 24*b* with respect to a sheet 70 may be lower than that of the detachment claws 24*a*. Therefore, a sheet 70 conveyed by the conveyor belt 8 comes into contact with the detachment claws 24*a* before the detachment claw 24*b* and becomes detached from the conveying surface 9 sequentially from the opposite end sections of the leading edge of the sheet 70, as viewed in the axial direction of the rotary shaft of the belt roller 6. This further facilitates the detachment of the sheet 70 from the conveying surface 9.

In addition, in the printer 1 according to the first embodiment, the conveying surface 9 may be constituted by an adhesive layer and may have bonded thereon non-adhesive films 9*a*. The surface of each film 9*a* defines a non-attachment region. On the other hand, areas of the adhesive layer that are not covered with the films 9*a* define attachment regions. Consequently, the non-attachment regions can be formed readily by bonding the films 9*a* onto the adhesive layer.

In the printer 1 according to the first embodiment, the films 9*a* may be given a silver color, which means that the non-attachment regions with the films 9*a* and the attachment regions without the films 9*a* have different light reflectivity. Therefore, the non-attachment regions and the attachment regions can be readily distinguished from each other using the film sensor 5, which is an optical sensor of a reflective type.

In the printer 1 according to the first embodiment, the belt roller 6 may have a diameter that is smaller than that of the belt roller 7. Consequently, since the periphery of the belt roller 6 has a relatively large curvature, the conveyor belt 8 wound around the belt roller 6 curves significantly. Thus, the sheet 70 can be readily detached from the conveyor belt 8 at the belt roller 6.

Second Embodiment

Figure 9:
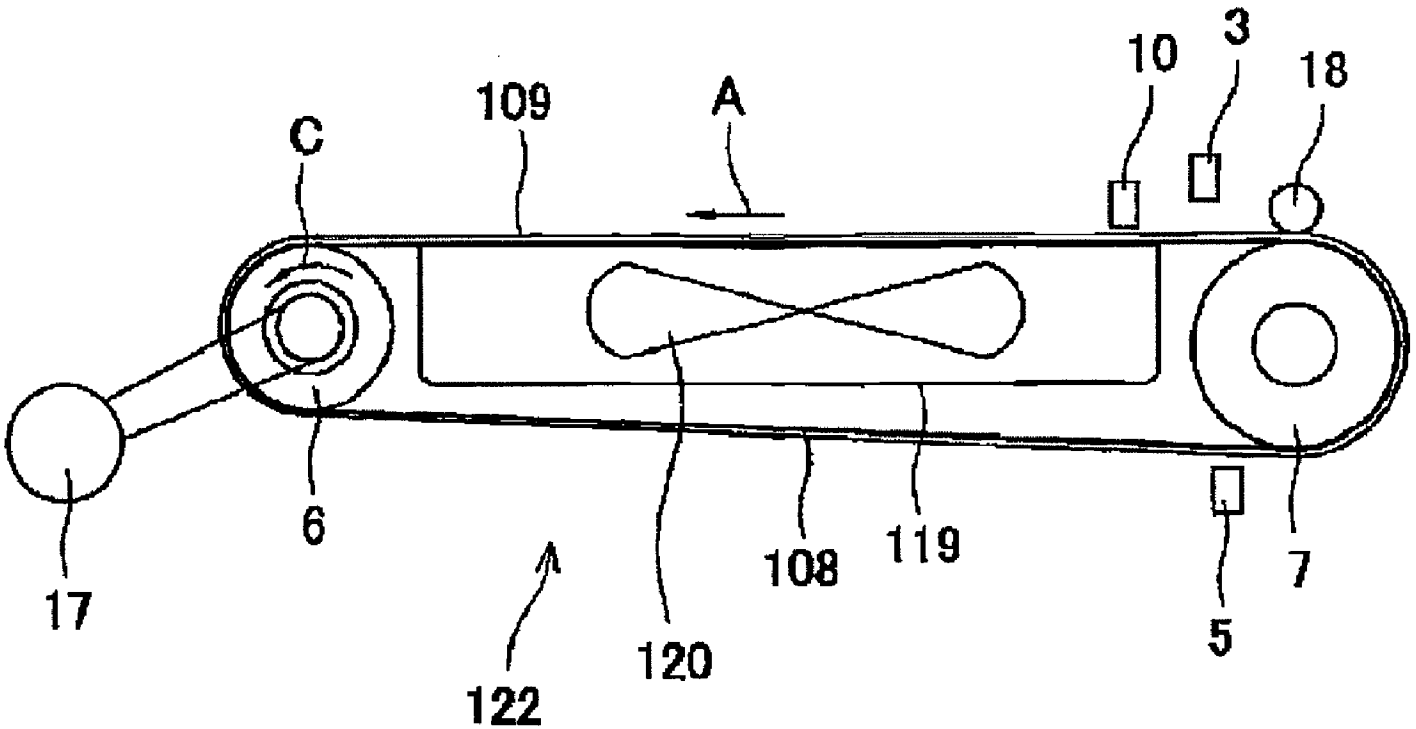
FIG. 9 is a schematic cross-sectional view of a conveyor mechanism and the peripheral area thereof of a second embodiment of a printer.
Figure 10:
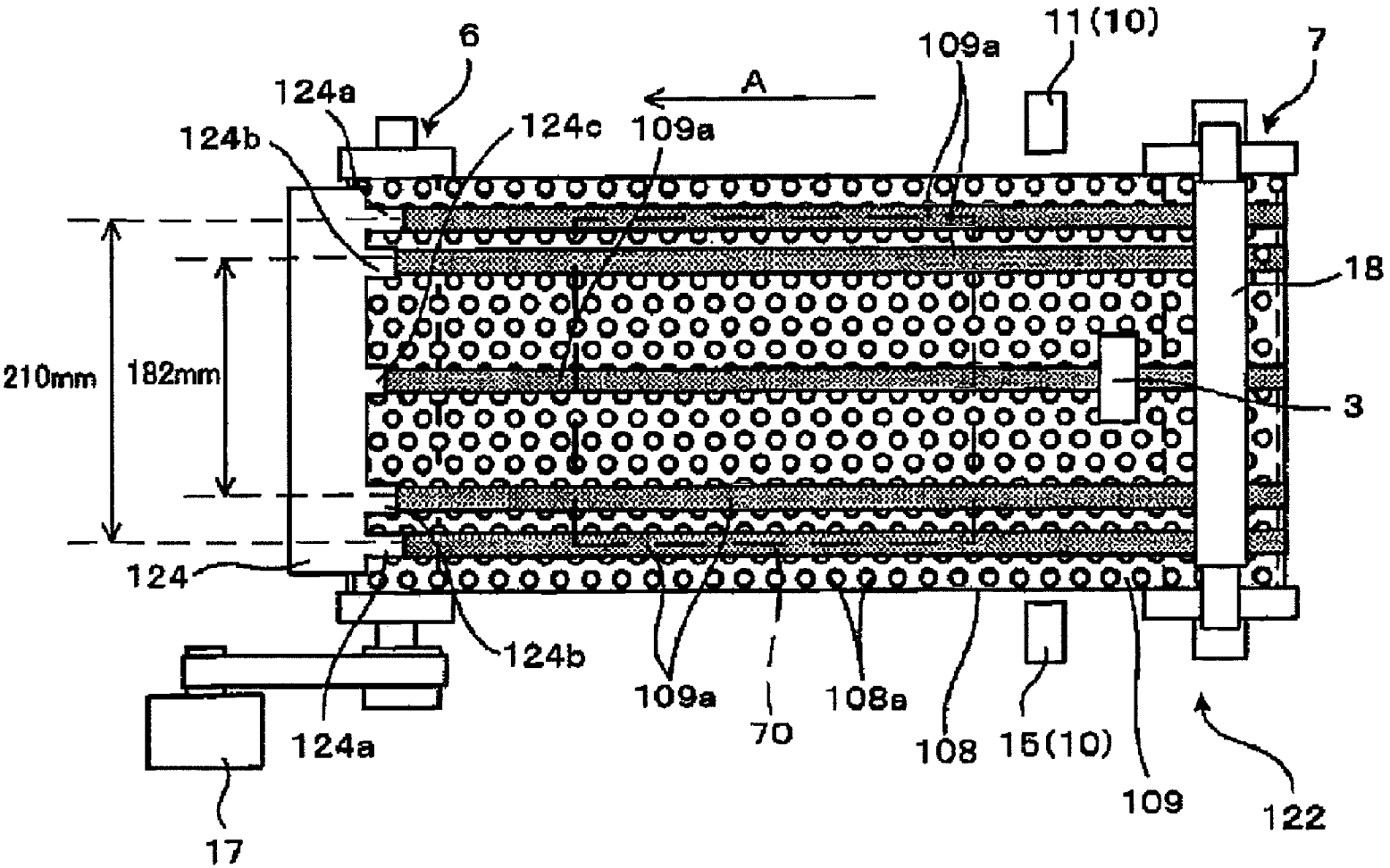
FIG. 10 is a plan view of the conveyor mechanism and the peripheral area thereof shown in FIG. 9.

A second embodiment of an image recording apparatus will now be described with reference to FIGS. 9 and 10. FIG. 9 is a schematic cross-sectional view of a conveyor mechanism and the peripheral area thereof of a printer according to the second embodiment. FIG. 10 is a plan view of the conveyor mechanism and the peripheral area thereof shown in FIG. 9. The printer according to the second embodiment is substantially the same as the printer 1 according to the first embodiment except for the structure of a conveyor mechanism 122. In the description below, the components that are the same as those in the first embodiment are given the same reference numerals, and descriptions of those components will not be repeated.

Referring to FIG. 10, a conveyor belt 108 according to the second embodiment may have a plurality of through holes 108*a* that are evenly distributed over the conveyor belt 108. A platen 119 that supports the conveyor belt 108 at the inner periphery surface thereof has an upper surface and a lower surface that may be provided with a plurality of holes (not shown). Referring to FIG. 9, the platen 119 may have a fan 120 disposed therein, which generates air flow from up to down. Therefore, the air above the conveyor belt 108 is drawn downward through the through holes 108*a*, whereby a sheet 70 set on a conveying surface 109 of the conveyor belt 108 becomes attached to the conveying surface 109. As in the first embodiment, the outer periphery surface of the conveyor belt 108 may be given a silicon treatment so as to have adhesiveness. Consequently, even when the fan 120 is stopped, the sheet 70 can still be attached to the conveying surface 109 supplementarily with the adhesiveness of the conveyor belt 108.

Referring to FIG. 10, the conveying surface 109 may have bonded thereon five non-adhesive films 109*a*. The five films 109*a* may all be disposed annularly in the driving direction of the conveyor belt 108 and may be bonded and arranged in the main scanning direction. The areas on the conveying surface 109 where the films 109*a* are bonded define non-attachment regions. Specifically, since the films 109*a* block the through holes 108*a* in these non-attachment regions, the air flow cannot attach the sheet 70 to these regions. Because the films 109*a* have no adhesiveness, the sheet 70 does not become attached to the non-attachment regions with the adhesiveness of the conveying surface 109. On the other hand, the areas on the conveying surface 109 where the films 109*a* are not bonded define attachment regions. In other words, the conveying surface 109 may have alternately arranged thereon in the main scanning direction the non-attachment regions and the attachment regions that extend annularly around the endless conveyor belt 108 suspended between the belt rollers 6 and 7. The fan 120 that generates downward air flow, the plurality of through holes 108*a* provided in the conveyor belt 108, and the films 109*a* correspond to attachment means for defining the attachment regions and the non-attachment regions on the conveying surface 9.

Of the five films 109*a*, the film 109*a* in the center may be positioned in the midsection of the conveyor belt 108 as viewed in the main scanning direction. The two films 109*a* disposed at opposite sides of the center film 109*a* and positioned at an equal distance from the center film 109*a* may be spaced apart from each other by 182 mm so as to correspond to the width of B5-size paper. The two outermost films 109*a* in the main scanning direction that may be positioned at an equal distance from the center film 109*a* may be spaced apart from each other by 210 mm so as to correspond to the width of A4-size paper. Accordingly, when a sheet 70 is fed from the sheet tray 25 while the midsection of the sheet 70 and the midsection of the conveyor belt 108 in the main scanning direction are aligned with each other by the positioning plates 28, the sheet 70 may be conveyed in a state such that the opposite sides of the sheet 70 extending in the conveying direction are always disposed on the non-attachment regions having the films 109*a* whether the sheet 70 is of B5 size or A4 size.

Referring to FIG. 10, a detachment plate 124 may five detachment claws 124*a*, 124*b*, and 124*c* projecting therefrom in a direction extending from the ejection tray 23 towards the conveyor belt 108 (i.e. from left to right in FIG. 10). As viewed in the axial direction of the rotary shaft of the belt roller 6 (i.e. the vertical direction in FIG. 10), the detachment claw 124*c* may be located in the center of the conveyor belt 108, the pair of detachment claws 124*b* are provided at opposite sides of the detachment claw 124*c*, and the pair of detachment claws 124*a* are provided opposite to the detachment claw 124*c* across the corresponding detachment claws 124*b*. The five detachment claws 124*a*, 124*b*, and 124*c* may be positioned in alignment with the five respective films 109*a* with respect to the conveying direction.

Similar to the first embodiment, the height of the upper surface of each of the detachment claws 124*a*, 124*b*, and 124*c* may be substantially aligned with the conveyance height. The detachment claws 124*b* located more inward in the main scanning direction than the detachment claws 124*a* may have tapered ends. For this reason, the end of each detachment claw 124*b* may be positioned lower than the conveyance height. Furthermore, the detachment claw 124*c* located more inward in the main scanning direction than the detachment claws 124*b* may have an end that is tapered more sharply than the tapered ends of the detachment claws 124*b*. Thus, the height of the end of the detachment claw 124*c* may be lower than that of the ends of the detachment claws 124*b*. In other words, the height of the ends of the five detachment claws 124*a*, 124*b*, and 124*c* may become lower with increasing distance from the opposite sides of the conveyor belt 108.

Consequently, when a sheet 70 of, for example, A4 size is held on the conveying surface 109 and is conveyed to an area near the belt roller 6 while the midsection of the sheet 70 and the midsection of the conveyor belt 108 in the main scanning direction are aligned with each other by the positioning plates 28, the opposite end sections of the leading edge of the sheet 70 in the conveying direction first come into contact with the two detachment claws 124*a* at the conveyance height. This causes the opposite end sections of the leading edge of the sheet 70 to become detached from the conveying surface 109. Subsequently, the leading edge of the sheet 70 comes into contact with the two detachment claws 124*b* at a height lower than the conveyance height, and then with the detachment claw 124*c* at an even lower height, whereby the leading edge of the sheet 70 becomes entirely detached from the conveying surface 109.

Accordingly, in the second embodiment, the leading edge of the sheet 70 may be partially positioned on the non-attachment regions of the conveying surface 109, and therefore, the leading edge may be partially not attached to the conveying surface 109. Thus, the sheet 70 can be detached easily from the conveyor belt 108 as in the first embodiment.

Furthermore, in the second embodiment, the attachment means may include the fan 120 that generates downward air flow, the plurality of through holes 108*a* provided in the conveyor belt 108, and the films 109*a*. Consequently, the second embodiment is similar to the first embodiment in that the non-attachment regions can be formed readily by bonding the films 109*a* onto the conveying surface 109.

Moreover, in the second embodiment, the non-attachment regions and the attachment regions may both extend annularly around the endless conveyor belt 108 suspended between the belt rollers 6 and 7. Thus, the leading edge of a sheet 70 can be partially disposed on the non-attachment regions regardless of the timing at which the sheet 70 is fed to the conveyor belt 108. Accordingly, this facilitates the control of the feeding process of the sheets 70.

In addition, the five non-attachment regions in the second embodiment may be arranged in the main scanning direction while having the attachment regions interposed therebetween. The two outermost non-attachment regions in the main scanning direction may be spaced apart from each other by a distance that corresponds to the width of A4-size paper, and the two non-attachment regions adjacent to the two outermost non-attachment regions may be spaced apart from each other by a distance that corresponds to the width of B5-size paper. The sheets 70 housed in the sheet tray 25 may be positioned in the main scanning direction by the positioning plates 28 so that the opposite sides of each sheet 70 extending in the conveying direction are disposed on the corresponding non-attachment regions. Accordingly, since the opposite sides of the sheet 70 extending in the conveying direction do not become attached to the conveying surface 109, the sheet 70 can be easily detached from the conveyor belt 108.

Third Embodiment

Figure 11:
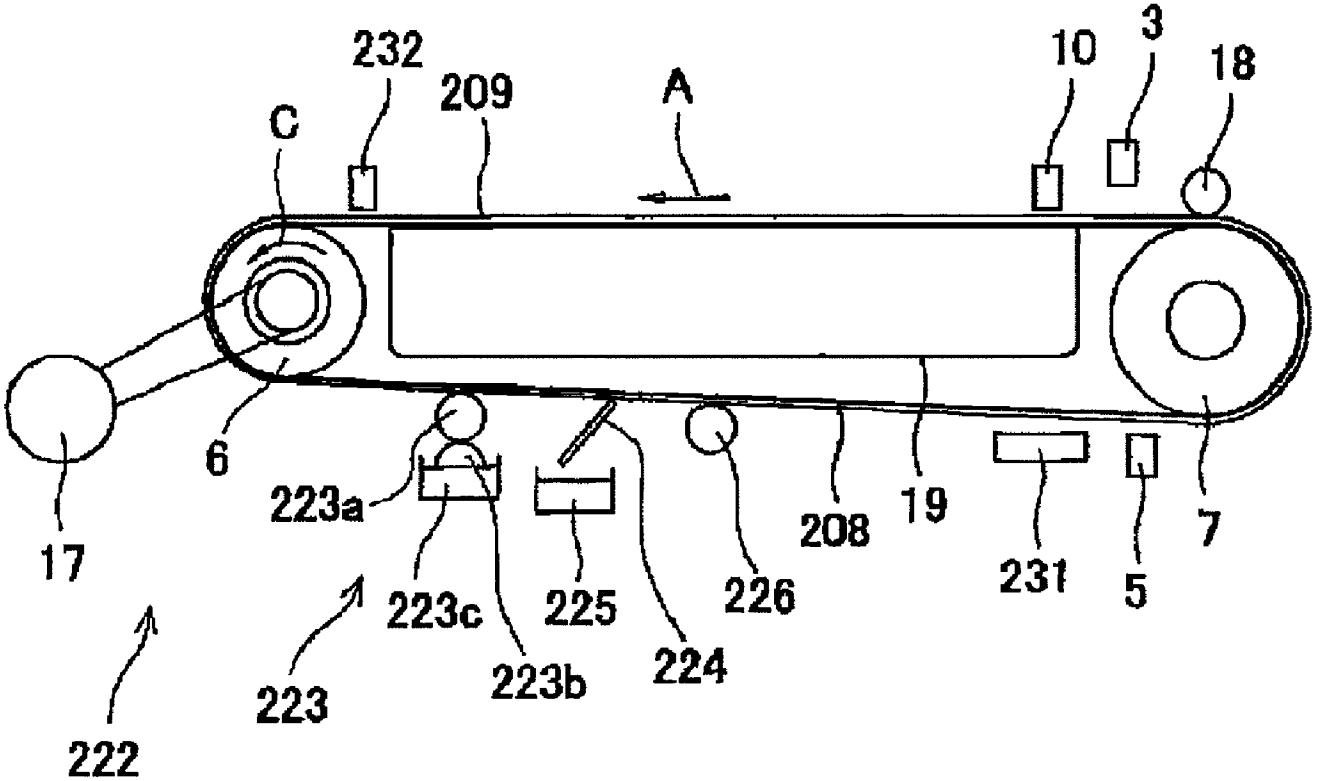
FIG. 11 is a schematic cross-sectional view of a conveyor mechanism and the peripheral area thereof of a third embodiment of a printer.
Figure 12:
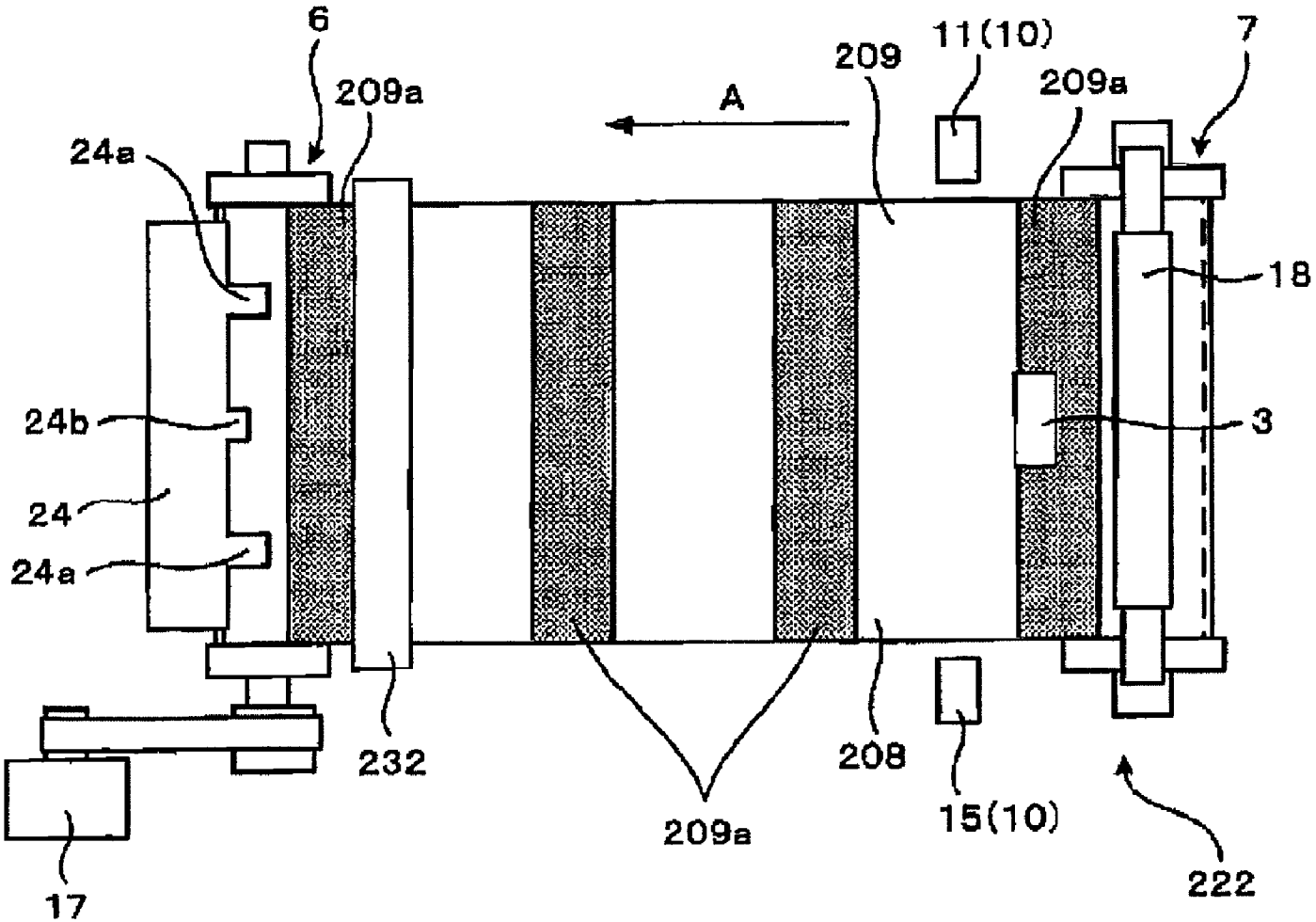
FIG. 12 is a plan view of the conveyor mechanism and the peripheral area thereof shown in FIG. 11.

A third embodiment of an image recording apparatus will now be described with reference to FIGS. 11 and 12. FIG. 11 is a schematic cross-sectional view of a conveyor mechanism and the peripheral area thereof of a printer according to the third embodiment. FIG. 12 is a plan view of the conveyor mechanism and the peripheral area thereof shown in FIG. 11. The printer according to the third embodiment differs from the printer 1 according to the first embodiment mainly in the following point. In the first embodiment, a sheet 70 can be attached to the conveyor belt 8 with the adhesiveness of the conveyor belt 8, whereas in the third embodiment, a sheet 70 can be attached to a conveyor belt 208 by means of an electrostatic force. Other components and configurations in the third embodiment are substantially the same as those in the first embodiment. The components that are substantially the same as those in the first embodiment are given the same reference numerals, and descriptions of those components will not be repeated.

The conveyor belt 208 according to the third embodiment may be composed of a high-polymer material having high insulation resistance, such as polyimide, polyamide, polycarbonate, or nylon, and may have high charge properties. Referring to FIG. 11, the conveyor belt 208 may be electrically charged by a charging device 231 disposed below the conveyor belt 208, and the electrical charge may be removed from the conveyor belt 208 by a charge-removing device 232 disposed above the conveyor belt 208 at a position downstream of the inkjet heads 2 in the conveying direction. The surface of the conveyor belt 208 may be given, for example, a polyurethane coating so as to have a high friction coefficient.

Referring to FIG. 12, a conveying surface 209 of the conveyor belt 208 may have a plurality of non-adhesive films 209*a* bonded and arranged thereon in the conveying direction (i.e. the direction of the arrow A). The films 209*a* may be composed of, for example, carbon and have lower charge properties than the conveyor belt 208. Consequently, the conveying surface 209 may have alternately arranged thereon in the conveying direction of the sheets 70 non-attachment regions where the films 209*a* are bonded and attachment regions where the films 209*a* are not bonded. Specifically, when a sheet 70 is placed on the conveying surface 209, the sheet 70 does not attach itself to the non-attachment regions but does attach itself to the attachment regions due to an electrostatic force generated as a result of the conveyor belt 208 being electrically charged by the charging device 231. In other words, the charging device 231 that electrically charges the conveyor belt 208 and the films 209*a* having lower charge properties than the conveyor belt 208 correspond to attachment means for defining the attachment regions and the non-attachment regions on the conveying surface 209.

Since the attachment regions have a high friction coefficient due to having, for example, a polyurethane coating as mentioned above, a surface tension may be generated as a result of ink being adhered to the conveying surface 209. Consequently, even when the conveyor belt 208 is not in a charged state, the sheet 70 can still be attached to the attachment regions supplementarily with the surface tension.

Underneath the conveyor belt 208 at a side closer to the belt roller 6 relative to the charging device 231 may be disposed a cleaning unit 223, a wiper 224, and a drying roller 226 in that order in the direction from the belt roller 6 towards the belt roller 7. The cleaning unit 223, the wiper 224, and the drying roller 226 correspond to cleaning means for removing dust and waste, such as paper dust of a sheet 70, adhered to the attachment regions of the conveying surface 209 due to an electrostatic force of the conveyor belt 208 in a charged state. In the third embodiment, the cleaning process is performed in a state where the electrical charge is removed from the conveyor belt 208 by the charge-removing device 232.

The cleaning unit 223 may include a cleaning roller 223*a* in contact with the conveying surface 209, a supply roller 223*b* in contact with the outer periphery surface of the cleaning roller 223*a* and supplying cleaning liquid to the cleaning roller 223*a*, and a cleaning-liquid tank 223*c* containing cleaning liquid and supplying the cleaning liquid to the supply roller 223*b*. The wiper 224 may be formed of an elastic sheet material of, for example, rubber and may have an edge that is in contact with the conveying surface 209. The wiper 224 may be inclined downward in a direction opposite to the driving direction of the conveyor belt 208 (i.e. a direction from the belt roller 6 towards the belt roller 7). Below the lower edge of the wiper 224 may be disposed a waste-liquid tank 225. The drying roller 226 may have hygroscopic properties and may be in contact with the conveying surface 209.

Accordingly, when the conveyor belt 208 is driven, the cleaning roller 223*a* in contact with the conveying surface 209 and the supply roller 223*b* rotate. At this time, the cleaning liquid contained in the cleaning-liquid tank 223*c* may be applied to the conveying surface 209 via the supply roller 223*b* and the cleaning roller 223*a*. Subsequently, the wiper 224 may wipe off the cleaning liquid applied to the conveying surface 209 together with dust and waste adhered to the conveying surface 209. The cleaning liquid containing the dust and waste wiped from the conveying surface 209 by the wiper 224 may travel along the upper surface of the wiper 224 so as to drip down into the waste-liquid tank 225. Finally, the conveying surface 209 wiped by the wiper 224 may be wiped and dried by the drying roller 226. In this manner, the dust and waste, such as paper dust of a sheet 70, adhered to the attachment regions of the conveying surface 209 may be removed.

Accordingly, the third embodiment is similar to the first embodiment in that the leading edge of a sheet 70 may be positioned on a non-attachment region and therefore may not be attached to the conveying surface 209, whereby the sheet 70 can be detached easily from the conveyor belt 208.

Furthermore, in the third embodiment, the attachment means may include the charging device 231 that electrically charges the conveyor belt 208, and the films 209*a* having lower charge properties than the conveyor belt 208. Consequently, the third embodiment is similar to the first embodiment in that the non-attachment regions can be formed readily by bonding the films 209*a* onto the conveying surface 209.

Moreover, the third embodiment may be provided with the charge-removing device 232 that removes the electrical charge from the conveyor belt 208 and also with the cleaning means for cleaning the conveying surface 209, which is constituted by the cleaning unit 223, the wiper 224, and the drying roller 226. Accordingly, with an electrostatic force of the conveyor belt 208 in a charged state, dust and waste including paper dust of a sheet 70 adhered to the attachment regions of the conveying surface 209 can be removed.

Although preferred embodiments of an image recording apparatus have been described above, the technical scope of the present patent is not limited to the above embodiments, and various design modifications are permissible within the scope of the claims. For example, although the conveying surface 9 (109, 209) in each of the first to third embodiments described above may have a plurality of attachment regions and non-attachment regions, the conveying surface may be such that it has at least one attachment region and at least one non-attachment region.

Furthermore, although each of the first to third embodiments described above may be equipped with a pair of positioning plates 28 for adjusting the position of the sheets 70 housed in the sheet tray 25 in the main scanning direction, the positioning plates 28 may be omitted.

In addition, although the belt roller 6 has a diameter smaller than that of the belt roller 7 in each of the first to third embodiments described above, the diameter of the belt roller 6 may be larger than or equal to that of the belt roller 7.

As described above, each of the first to third embodiments may be equipped with a plurality of detachment claws 24*a* and 24*b* (124*a*, 124*b*, 124*c*) for detaching a sheet 70 from the conveying surface 9 (109, 209). Of the plurality of detachment claws 24*a* and 24*b* (124*a*, 124*b*, 124*c*), the detachment claws located farther away from the opposite sides of the conveyor belt 8 (108, 208) in the axial direction of the rotary shaft of the belt roller 6 come into contact with the sheet 70 at lower positions. However, the image recording apparatus is not limited to this configuration, and the plurality of detachment claws 24*a* and 24*b* (124*a*, 124*b*, 124*c*) may alternatively be contactable with the sheet 70 at the same height.

In each of the first and third embodiments described above, a reflective-type optical sensor may be provided as a film sensor 5 for detecting a non-attachment region of the conveying surface 9 (209) where a film 9*a* (209*a*) is bonded. However, the means for detecting a non-attachment region is not limited to the film sensor 5. For example, the non-attachment regions may be defined by light blocking films bonded to the conveying surface 9 (209) of a transparent conveyor belt 8 (208), and in that case, the detection of a non-attachment region may be implemented by detecting a light blocking film using a transmissive-type optical sensor.

Furthermore, in each of the first and third embodiments described above, the films 9*a* (209*a*) may be silver-colored, and the non-attachment regions with the films 9*a* (209*a*) and the attachment regions without the films 9*a* (209*a*) have different light reflectivity. However, the image recording apparatus is not limited to this configuration, and the non-attachment regions and the attachment regions may have the same light reflectivity.

In the second embodiment described above, five non-attachment regions may be arranged in the main scanning direction while having the attachment regions interposed therebetween. Moreover, the two outermost non-attachment regions in the main scanning direction may be spaced apart from each other by a distance that corresponds to the width of A4-size paper, and the two non-attachment regions adjacent to the two outermost non-attachment regions may be spaced apart from each other by a distance that corresponds to the width of B5-size paper. However, the image recording apparatus is not limited to this configuration. The conveying surface 109 may alternatively have non-attachment regions that correspond to the widths of paper having sizes other than A4-size and B5-size.

Although the third embodiment described above may be equipped with the charge-removing device 232 that removes an electrical charge from the conveyor belt 208 and also with the cleaning means for cleaning the conveying surface 209, which is constituted by the cleaning unit 223, the wiper 224, and the drying roller 226, the charge-removing device 232 and the cleaning means can be omitted.

As described above, the first embodiment applies an adhesion method in which a sheet 70 may be attached to the conveying surface 9 by means of the adhesiveness of the adhesive layer, and in which the conveying surface 9 may have non-attachment regions and attachment regions alternately arranged thereon in the conveying direction. On the other hand, the second embodiment applies an air suction method in which a sheet 70 may be attached to the conveying surface 109 by means of downward air flow, and in which the conveying surface 109 may have non-attachment regions and attachment regions extending annularly around the endless conveyor belt 108 suspended between the belt rollers 6 and 7. The third embodiment may apply a charging method in which a sheet 70 may be attached to the conveying surface 209 by means of an electrostatic force of the conveyor belt 208 in a charged state, and in which the conveying surface 209 may have non-attachment regions and attachment regions alternately arranged thereon in the conveying direction. Alternatively, the combination between these attachment methods for attaching a sheet 70 to the conveying surface 9 (109, 209) and the patterns of the non-attachment regions and attachment regions formed on the conveying surface 9 (109, 209) may be appropriately modified.

What is claimed is:

1. An image recording apparatus comprising:

a recording head that records an image on a recording medium;

a conveyor supporting the recording medium on an outer surface thereof so as to convey the recording medium in a conveying direction, and having a first attachment region and a second attachment region on the outer surface, the first and second attachment regions each extending one of across an entirety of the conveyor in a direction orthogonal to the conveying direction and annularly around an entire outer surface of the conveyor, said recording medium being attachable to the first attachment region with a first attachment force greater than a second attachment force of said second attachment region; and a medium feeder configured to feed the recording medium to the conveyor so that at least a part of a leading edge of the recording medium in the conveying direction is positioned on said second attachment region.

2. The image recording apparatus according to claim 1, wherein said conveyor is a belt, and said first attachment region and said second attachment region each extend annularly around the outer surface of the conveyor belt.

3. The image recording apparatus according to claim 2, wherein said conveyor belt includes a plurality of annularly extending first attachment regions and a plurality of annularly extending second attachment regions, and the medium feeder is configured to position the recording medium so that each of opposite sides of the recording medium extending in the conveying direction is disposed on one of the second attachment regions.

4. The image recording apparatus according to claim 1, wherein said first attachment region and said second attachment region are alternately arranged in the conveying direction on the conveyor, the image recording apparatus further comprises a detector configured to detect a position of at least one of said first attachment region and said second attachment region, and the medium feeder is configured to feed the recording medium to the conveyor on the basis of a detection result of the detector so that the leading end of the recording medium is positioned on said second attachment region.

5. The image recording apparatus according to claim 4, wherein the detector comprises an optical sensor of a reflective type.

6. The image recording apparatus according to claim 1, further comprising a plurality of detachment claws for detaching the recording medium from the outer surface of the conveyor;

wherein a central detachment claw comes into contact with the recording medium at a lower position than a position of detachment claws located closest to the opposite sides of the conveyor extending in the conveying direction.

7. The image recording apparatus according to claim 6, further comprising a pair of tapered detachment claws, each tapered detachment claw being positioned between the central detachment claw and one of the detachment claws closest to the opposite sides and coming into contact with the recording medium at a lower position than the position of the detachment claws located closest to the opposite sides and at a higher position than the position of the central claw, the central detachment claw being tapered more sharply than the tapered detachment claws.

8. The image recording apparatus according to claim 1, further comprising:

an adhesive layer on the outer surface of the conveyor; and a non-adhesive sheet bonded to the adhesive layer;

wherein a surface of said non-adhesive sheet defines said second attachment region; and a part of a surface of the adhesive layer that is not covered with said non-adhesive sheet defines said first attachment region.

9. The image recording apparatus according to claim 1, further comprising:

an air-flow generating device for generating air flow that allows the recording medium to be attached to the outer surface of the conveyor; and a non-adhesive sheet bonded to the conveyor;

wherein the conveyor includes a plurality of through holes;

a surface of said non-adhesive sheet defines said second attachment region; and a part of the outer surface of the conveyor that is not covered with said non-adhesive sheet defines said first attachment region.

10. The image recording apparatus according to claim 1, further comprising:

a charging device that electrically charges the conveyor; and a non-adhesive sheet bonded to the conveyor and having a lower charge property than a charge property of the outer surface of the conveyor;

wherein a surface of said non-adhesive sheet defines said second attachment region; and a part of the outer surface of the conveyor that is not covered with said non-adhesive sheet defines said first attachment region.

11. The image recording apparatus according to claim 10, further comprising:

a charge-removing device that removes an electrical charge from the conveyor; and a cleaning assembly configured to clean the outer surface of the conveyor.

12. The image recording apparatus according to claim 1, wherein the conveyor is a belt; and further comprising first and second rollers supporting the conveyor belt, the second roller having a diameter smaller than a diameter of the first roller.

13. The image recording apparatus according to claim 1, wherein said conveyor includes a plurality of first attachment regions and a plurality of second attachment regions.

14. The image recording apparatus according to claim 1, further comprising a separation sensor configured to detect a distance that a leading edge of the recording medium is separated from the conveyor.

15. The image recording apparatus according to claim 14, further comprising a controller that controls a size of a gap between the recording head and the recording medium based on the distance that the recording medium is separated from the conveyor.

16. The image recording apparatus according to claim 14, further comprising a controller that controls an amount of ink discharged from the recording head based on the distance that the recording medium is separated from the conveyor.

17. The image recording apparatus according to claim 14, wherein the separation sensor detects if the recording medium is separated from the conveyor within one of a first predetermined range, a second predetermined range that is greater than the first predetermined range, a third predetermined range that is greater than the second predetermined range, and a fourth predetermined range that is greater than the third predetermined range.

18. The image recording apparatus according to claim 17, further comprising a controller that aborts a discharge of ink from the recording heads when the recording medium is separated from the conveyor belt within the fourth predetermined range.

19. The image recording apparatus according to claim 17, further comprising a controller that reduces a conveying rate of the recording medium when the recording medium is separated from the conveyor within the third predetermined range.

20. An image recording apparatus comprising:

a recording head that records an image on a recording medium;

a conveyor belt extended between first and second rollers, the conveyor belt supporting the recording medium on an outer surface thereof so as to convey the recording medium in a conveying direction extending from the first roller towards the second roller, and having a first attachment region and a second attachment region on the outer surface, the first and second attachment regions each extending one of across an entirety of the conveyor belt in a direction orthogonal to the conveying direction and annularly around an entire outer surface of the conveyor belt, said recording medium being attachable to the first attachment region with a first attachment force that is greater than a second attachment force of the second attachment region;

a medium feeder configured to feed the recording medium to the conveyor belt so that at least a part of a leading edge of the recording medium in the conveying direction is positioned on said second attachment region;

a separation sensor configured to detect a distance that a leading edge of the recording medium is separated from the conveyor belt; and a controller configured to control, based on the distance that the recording medium is separated from the conveyor belt, a rate of conveyance of the conveyor belt, a gap between the recording head and the recording medium, and an amount of ink discharged from the recording head.

* * * * *